US010309158B2

(12) United States Patent
Mukhopadhyay et al.

(10) Patent No.: US 10,309,158 B2
(45) Date of Patent: Jun. 4, 2019

(54) METHOD OF PARTIALLY INFILTRATING AN AT LEAST PARTIALLY LEACHED POLYCRYSTALLINE DIAMOND TABLE AND RESULTANT POLYCRYSTALLINE DIAMOND COMPACTS

(75) Inventors: Debkumar Mukhopadhyay, Sandy, UT (US); Kenneth E. Bertagnolli, Riverton, UT (US); Jair J. Gonzalez, Provo, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 337 days.

(21) Appl. No.: 12/961,787

(22) Filed: Dec. 7, 2010

(65) Prior Publication Data

US 2012/0138370 A1 Jun. 7, 2012

(51) Int. Cl.
*E21B 10/55* (2006.01)
*B22F 7/06* (2006.01)
(Continued)

(52) U.S. Cl.
CPC ..... *E21B 10/5735* (2013.01); *B22F 7/06* (2013.01); *B24D 3/10* (2013.01); *C22C 26/00* (2013.01);
(Continued)

(58) Field of Classification Search
None
See application file for complete search history.

(56) References Cited

U.S. PATENT DOCUMENTS 2,349,577 A 5/1944 Dean
3,743,489 A 7/1973 Wentorf, Jr. et al.
(Continued)

FOREIGN PATENT DOCUMENTS

EP 0 297 071 12/1988
EP 0 352 811 1/1990
(Continued)

OTHER PUBLICATIONS

U.S. Appl. No. 12/363,104, Aug. 25, 2011, Notice of Allowance.
(Continued)

*Primary Examiner* — Kaj K Olsen
*Assistant Examiner* — Ross J Christie
(74) *Attorney, Agent, or Firm* — Dorsey & Whitney LLP

(57) ABSTRACT

In an embodiment, a method of fabricating a polycrystalline diamond compact ("PDC") includes forming a polycrystalline diamond ("PCD") table in the presence of a metal-solvent catalyst in a first high-pressure/high-temperature ("HPHT") process. The PCD table includes bonded diamond grains defining interstitial regions, with the metal-solvent catalyst disposed therein. The method includes at least partially leaching the PCD table to remove at least a portion of the metal-solvent catalyst therefrom. The method includes subjecting the at least partially leached PCD table and a substrate to a second HPHT process under diamond-stable temperature-pressure conditions to partially infiltrate the at least partially leached PCD table with an infiltrant. A maximum temperature (T), a total process time (t), and a maximum pressure (P) of the second HPHT process are chosen so that β is about 2° Celsius·hours/gigapascals ("° C.·h/GPa") to about 325° C.·h/GPa, with β represented as β=T·t/P.

24 Claims, 10 Drawing Sheets

(51) Int. Cl.

| | |
|---|---|
| ***B24D 3/10*** | (2006.01) |
| ***C22C 26/00*** | (2006.01) |
| ***E21B 10/567*** | (2006.01) |
| ***E21B 10/573*** | (2006.01) |
| *B22F 5/00* | (2006.01) |

(52) U.S. Cl.

CPC ..... *E21B 10/55* (2013.01); *E21B 10/567* (2013.01); *B22F 2005/001* (2013.01); *Y10T 428/24777* (2015.01)

(56) References Cited

U.S. PATENT DOCUMENTS 3,745,623 A 7/1973 Wentorf, Jr. et al.
3,767,371 A 10/1973 Wentorf, Jr. et al.
3,786,552 A 1/1974 Saito et al.
3,918,219 A 11/1975 Wentorf, Jr. et al.
4,009,027 A 2/1977 Naidich et al.
4,016,736 A * 4/1977 Carrison et al. ..... 72/41
4,063,909 A 12/1977 Mitchell
4,084,942 A 4/1978 Villalobos
4,191,735 A 3/1980 Nelson et al.
4,224,380 A 9/1980 Bovenkerk et al.
4,268,276 A 5/1981 Bovenkerk
4,274,900 A 6/1981 Mueller et al.
4,288,248 A 9/1981 Bovenkerk et al.
4,333,902 A 6/1982 Hara
4,410,054 A 10/1983 Nagel et al.
4,460,382 A 7/1984 Ohno
4,440,573 A 8/1984 Ishizuka
4,468,138 A 8/1984 Nagel
4,525,179 A * 6/1985 Gigl ..... B01J 3/062 51/307
4,560,014 A 12/1985 Geczy
4,676,124 A 6/1987 Fischer
4,692,418 A 9/1987 Boecker et al.
4,738,322 A 4/1988 Hall et al.
4,766,027 A 8/1988 Burn et al.
4,778,486 A 10/1988 Csillag et al.
4,783,245 A 11/1988 Nakamura et al.
4,797,326 A * 1/1989 Csillag ..... 428/552
4,811,801 A 3/1989 Salesky et al.
4,871,377 A 10/1989 Frushour
4,913,247 A 4/1990 Jones
4,940,180 A 7/1990 Martell
4,944,772 A 7/1990 Cho
4,985,051 A 1/1991 Ringwood
4,992,082 A 2/1991 Drawl et al.
5,000,273 A 3/1991 Horton et al.
5,011,514 A 4/1991 Cho et al.
5,016,718 A 5/1991 Tandberg
5,032,147 A 7/1991 Frushour
5,049,164 A 9/1991 Horton et al.
5,057,124 A 10/1991 Cerceau
5,092,687 A 3/1992 Hall
5,116,568 A 5/1992 Sung et al.
5,120,327 A 6/1992 Dennis
5,127,923 A * 7/1992 Bunting ..... B24D 3/007 51/309
5,135,061 A 8/1992 Newton, Jr.
5,151,107 A 9/1992 Cho et al.
5,154,245 A 10/1992 Waldenstrom et al.
5,173,091 A 12/1992 Marek
5,180,022 A 1/1993 Brady
5,217,154 A 6/1993 Elwood et al.
5,304,342 A 4/1994 Hall, Jr. et al.
5,326,380 A 7/1994 Yao et al.
5,348,109 A 9/1994 Griffin et al.
5,355,969 A 10/1994 Hardy et al.
5,364,192 A 11/1994 Damm et al.
5,368,398 A 11/1994 Damm et al.
5,370,195 A 12/1994 Keshavan et al.
5,460,233 A 10/1995 Meany et al.
5,480,233 A 1/1996 Cunningham
5,544,713 A 8/1996 Dennis
5,617,997 A 4/1997 Kobayashi et al.
5,645,617 A 7/1997 Frushour
5,660,075 A 8/1997 Johnson et al.
5,722,499 A 3/1998 Nguyen et al.
5,740,874 A 4/1998 Matthias
5,819,862 A 10/1998 Matthias et al.
5,876,859 A 3/1999 Saxelby, Jr. et al.
5,954,147 A 9/1999 Overstreet et al.
5,976,707 A 11/1999 Grab
6,054,693 A 4/2000 Barmatz et al.
6,165,616 A 12/2000 Lemelson et al.
6,196,340 B1 3/2001 Jensen et al.
6,202,770 B1 3/2001 Jurewicz et al.
6,202,772 B1 3/2001 Eyre et al.
6,209,429 B1 4/2001 Urso, III et al.
6,220,375 B1 4/2001 Butcher et al.
6,258,139 B1 7/2001 Jensen
6,270,548 B1 8/2001 Campbell et al.
6,272,753 B2 8/2001 Packer
6,302,225 B1 10/2001 Yoshida et al.
6,338,754 B1 1/2002 Cannon et al.
6,344,149 B1 2/2002 Oles
6,390,181 B1 * 5/2002 Hall et al. ..... 165/80.3
6,405,814 B1 6/2002 Eyre et al.
6,410,085 B1 6/2002 Griffin et al.
6,435,058 B1 8/2002 Matthias et al.
6,481,511 B2 11/2002 Matthias et al.
6,544,308 B2 4/2003 Griffin et al.
6,562,462 B2 5/2003 Griffin et al.
6,585,064 B2 7/2003 Griffin et al.
6,589,640 B2 7/2003 Griffin et al.
6,592,985 B2 7/2003 Griffin et al.
6,601,662 B2 8/2003 Matthias et al.
6,739,214 B2 5/2004 Griffin et al.
6,749,033 B2 6/2004 Griffin et al.
6,793,681 B1 9/2004 Pope et al.
6,797,326 B2 9/2004 Griffin et al.
6,861,098 B2 3/2005 Griffin et al.
6,861,137 B2 3/2005 Griffin et al.
6,878,447 B2 4/2005 Griffin et al.
6,892,836 B1 5/2005 Eyre et al.
6,991,049 B2 1/2006 Eyre et al.
7,060,641 B2 6/2006 Qian et al.
7,377,341 B2 5/2008 Middlemiss et al.
7,384,821 B2 6/2008 Sung
7,473,287 B2 1/2009 Belnap et al.
7,516,804 B2 4/2009 Vail
7,552,782 B1 6/2009 Sexton et al.
7,559,695 B2 7/2009 Sexton et al.
7,559,965 B2 7/2009 Oh
7,569,176 B2 8/2009 Pope et al.
7,635,035 B1 12/2009 Bertagnolli et al.
7,647,933 B2 1/2010 Morgenstern et al.
7,726,421 B2 6/2010 Middlemiss
7,753,143 B1 7/2010 Miess et al.
7,754,333 B2 7/2010 Eyre et al.
7,828,088 B2 11/2010 Middlemiss et al.
7,841,428 B2 11/2010 Bertagnolli
7,866,418 B2 1/2011 Bertagnolli et al.
7,980,334 B2 7/2011 Voronin et al.
8,002,859 B2 8/2011 Griffo et al.
8,056,650 B2 11/2011 Middlemiss
8,066,087 B2 11/2011 Griffo et al.
8,069,937 B2 12/2011 Mukhopadhyay
8,080,071 B1 12/2011 Vail et al.
8,236,074 B1 8/2012 Bertagnolli
8,297,382 B2 10/2012 Bertagnolli et al.
8,323,367 B1 12/2012 Bertagnolli
8,328,891 B2 12/2012 Zhang et al.
8,353,371 B2 1/2013 Cooley et al.
8,415,033 B2 4/2013 Matsuzawa et al.
8,616,306 B2 12/2013 Bertagnolli et al.
8,784,517 B1 7/2014 Gonzalez et al.
8,911,521 B1 12/2014 Miess et al.
8,979,956 B2 3/2015 Sani
2001/0004946 A1 6/2001 Jensen
2001/0040053 A1 11/2001 Beuershausen
2002/0029909 A1 3/2002 Griffo et al.
2002/0079140 A1 6/2002 Eyre et al.

(56) References Cited

U.S. PATENT DOCUMENTS

2003/0019333 A1 1/2003 Scott
2003/0037964 A1 2/2003 Sinor et al.
2003/0079918 A1 5/2003 Eyre et al.
2003/0191533 A1 10/2003 Dixon et al.
2004/0111159 A1 6/2004 Pope et al.
2004/0112650 A1 6/2004 Moseley
2004/0155096 A1 8/2004 Zimmerman et al.
2005/0044800 A1 3/2005 Hall et al.
2005/0050801 A1 3/2005 Cho et al.
2005/0117984 A1 6/2005 Eason et al.
2005/0189443 A1 9/2005 Taylor et al.
2005/0210755 A1 9/2005 Cho et al.
2005/0211475 A1 9/2005 Mirchandani et al.
2005/0230156 A1 10/2005 Belnap et al.
2005/0247492 A1 11/2005 Shen et al.
2005/0263328 A1 12/2005 Middlemiss
2006/0042172 A1 3/2006 Sung
2006/0054363 A1 3/2006 Eyre et al.
2006/0060390 A1 3/2006 Eyre
2006/0060391 A1 3/2006 Eyre et al.
2006/0060392 A1 3/2006 Eyre
2006/0157884 A1 7/2006 Ludtke et al.
2006/0165993 A1 7/2006 Keshavan
2006/0180354 A1 8/2006 Belnap et al.
2006/0191723 A1 8/2006 Keshavan
2006/0207802 A1 9/2006 Zhang et al.
2006/0254830 A1 11/2006 Radtke
2006/0263233 A1 11/2006 Gardinier
2006/0266558 A1* 11/2006 Middlemiss et al. ..... 175/426
2006/0266559 A1* 11/2006 Keshavan ..... B01J 3/062 175/428
2007/0023206 A1 2/2007 Keshavan et al.
2007/0034416 A1 2/2007 Cho et al.
2007/0056778 A1* 3/2007 Webb et al. ..... 175/434
2007/0079994 A1* 4/2007 Middlemiss ..... 175/426
2007/0102202 A1 5/2007 Choe et al.
2007/0187153 A1* 8/2007 Bertagnolli ..... 175/374
2007/0187155 A1* 8/2007 Middlemiss ..... 175/428
2007/0284152 A1 12/2007 Eyre et al.
2008/0010905 A1 1/2008 Eyre
2008/0019098 A1 1/2008 Sung
2008/0073126 A1* 3/2008 Shen ..... E21B 10/567 175/434
2008/0085407 A1 4/2008 Cooley et al.
2008/0099250 A1 5/2008 Hall et al.
2008/0115421 A1* 5/2008 Sani ..... 51/295
2008/0142276 A1* 6/2008 Griffo et al. ..... 175/432
2008/0206576 A1* 8/2008 Qian et al. ..... 51/307
2008/0223575 A1 9/2008 Oldham et al.
2008/0223621 A1* 9/2008 Middlemiss et al. ..... 51/307
2008/0223623 A1* 9/2008 Keshavan et al. ..... 175/434
2008/0230279 A1 9/2008 Bitler et al.
2008/0230280 A1* 9/2008 Keshavan et al. ..... 175/434
2008/0247899 A1 10/2008 Cho et al.
2009/0120009 A1 5/2009 Sung
2009/0152015 A1 6/2009 Sani et al.
2009/0152018 A1* 6/2009 Sani ..... 175/432
2009/0166094 A1 7/2009 Keshavan et al.
2009/0173015 A1 7/2009 Keshavan et al.
2009/0173547 A1 7/2009 Voronin et al.
2009/0313908 A1* 12/2009 Zhang et al. ..... 51/309
2010/0012389 A1 1/2010 Zhang et al.
2010/0038148 A1 2/2010 King
2010/0095602 A1 4/2010 Belnap et al.
2010/0104874 A1* 4/2010 Yong et al. ..... 428/408
2010/0122852 A1 5/2010 Russell et al.
2010/0155149 A1 6/2010 Keshavan et al.
2010/0181117 A1* 7/2010 Scott ..... C04B 35/52 51/307
2010/0186303 A1* 7/2010 Ras et al. ..... 51/309
2010/0196717 A1 8/2010 Liversage et al.
2010/0236836 A1* 9/2010 Voronin ..... B22F 7/04 51/309
2010/0243336 A1 9/2010 Dourfaye et al.
2010/0281782 A1* 11/2010 Keshavan et al. ..... 51/295
2010/0287845 A1 11/2010 Montross et al.
2010/0294571 A1 11/2010 Belnap et al.
2011/0023375 A1 2/2011 Sani et al.
2011/0031031 A1 2/2011 Vempati et al.
2011/0036643 A1* 2/2011 Belnap ..... C22C 26/00 51/307
2011/0042149 A1 2/2011 Scott et al.
2011/0056753 A1* 3/2011 Middlemiss et al. ..... 175/428
2011/0067929 A1* 3/2011 Mukhopadhyay et al. .... 51/307
2011/0083908 A1* 4/2011 Shen et al. ..... 51/307
2011/0088950 A1 4/2011 Scott et al.
2011/0283628 A1 11/2011 Saridikmen et al.
2011/0284294 A1 11/2011 Cox et al.
2012/0037429 A1 2/2012 Davies et al.
2012/0080239 A1 4/2012 Lyons et al.
2012/0103701 A1 5/2012 Cho et al.
2012/0228037 A1 9/2012 Cooley et al.
2012/0241224 A1 9/2012 Qian et al.
2013/0205677 A1 8/2013 Bertagnolli et al.
2013/0291443 A1 11/2013 Naidoo et al.
2013/0313027 A1 11/2013 Sani
2014/0223835 A1 8/2014 Thigpen et al.
2014/0283457 A1 9/2014 Cariveau et al.
2015/0114726 A1 4/2015 Shen et al.

FOREIGN PATENT DOCUMENTS

EP 0 374 424 6/1990
EP 0 699 642 3/1996
EP 2572011 3/2013
GB 2300424 11/1996
GB 2 461 198 12/2009
JP S59219500 12/1984
WO WO/2008/063568 5/2008
WO WO 2009/125355 10/2009
WO WO 2010/039346 4/2010
WO 2010/100629 9/2010
WO 2010/100630 9/2010
WO WO 2010/098978 9/2010

OTHER PUBLICATIONS

U.S. Appl. No. 12/271,081, Aug. 8, 2011, Office Action.
U.S. Appl. No. 11/983,619, Jun. 16, 2011, Notice of Allowance.
U.S. Appl. No. 13/690,397, May 29, 2013, Notice of Allowance.
U.S. Appl. No. 13/032,350, filed Feb. 22, 2011, Sani.
U.S. Appl. No. 11/983,619, Mar. 28, 2011, Office Action.
U.S. Appl. No. 12/363,104, Apr. 12, 2011, Office Action.
U.S. Appl. No. 12/271,081, Mar. 31, 2011, Office Action.
International Search Report and Written Opinion from International Application No. PCT/US2011/060380 dated Mar. 12, 2012.
U.S. Appl. No. 13/292,491, filed Nov. 9, 2011, Sani.
U.S. Appl. No. 13/230,125, May 23, 2012, Office Action.
U.S. Appl. No. 13/285,198, Apr. 3, 2012, Office Action.
U.S. Appl. No. 13/230,125, May 1, 2013, Notice of Allowance.
U.S. Appl. No. 13/292,900, May 23, 2013, Office Action.
U.S. Appl. No. 61/068,120, filed Mar. 3, 2008, Vail.
U.S. Appl. No. 12/548,584, filed Aug. 27, 2009, Bertagnolli.
U.S. Appl. No. 13/027,954, filed Feb. 15, 2011, Miess et al.
U.S. Appl. No. 13/100,388, filed May 4, 2011, Jones et al.
U.S. Appl. No. 13/171,735, filed Jun. 29, 2011, Bertagnolli.
U.S. Appl. No. 13/292,900, filed Nov. 9, 2011, Vail.
U.S. Appl. No. 13/323,138, filed Dec. 12, 2011, Miess et al.
U.S. Appl. No. 13/690,397, filed Nov. 30, 2012, Miess et al.
U.S. Appl. No. 13/397,971, filed Feb. 16, 2012, Miess et al.
Akaishi, Minoru, "Synthesis of polycrystalline diamond compact with magnesium carbonate and its physical properties," Diamond and Related Materials, 1996 (pp. 2-7).
Glowka, D.A. & Stone, C.M., "Effects of Termal and Mechanical Loading on PDC Bit Life", SPE Drilling Engineering, Jun. 1986 (pp. 201-214).
Hosomi, Satoru, et al., "Diamond Formation by a Solid State Reaction", Science and Technology of New Diamond, pp. 239-243 (1990).

(56) References Cited

OTHER PUBLICATIONS

Hsueh, C.H. & Evans, A.G., "Residual Stresses in Metal/Ceramic Bonded Strips", J. Am. Ceram. Soc., 68 [5] (1985) pp. 241-248.
Ledbetter, H.M., et al. "Elastic Properties of Metals and Alloys. II. Copper", Journal of Physics and Chemical Reference Data, vol. 3, No. 4, 1974. pp. 897-935.
Lin, Tze-Pin; Hood, Michael & Cooper George A., "Residual Stresses in Polycrystalline Diamond Compacts", J. Am. Ceram Soc., 77 [6] (1994) pp. 1562-1568.
Liu, Xueran, et al., "Fabrication of the supersaturated solid solution of carbon in copper by mechanical alloying", Materials Characterization, vol. 58, Issue 8 (Jun. 2007), pp. 504-508.
Orwa, J.O., et al., "Diamond nanocrystals formed by direct implantation of fused silica with carbon," Journal of Applied Physics, vol. 90, No. 6, 2001, pp. 3007-3018.
Radtke, Robert, "Faster Drilling, Longer Life: Thermally Stable Diamond Drill Bit Cutters," Drilling Systems, Summer 2004 (pp. 5-9).
Saji, S., et al., Solid Solubility of Carbon in Copper during Mechanical Alloying, Materials Transactions, vol. 39, No. 7 (1998), pp. 778-781.
Suryanarayana, C., "Novel Methods of Brazing Dissimilar Materials," Advanced Materials & Processes, Mar. 2001 (3 pgs).
Tanaka, T., et al., "Formation of Metastable Phases of Ni—C and Co—C Systems by Mechanical Alloying", Metallurgical Transactions, vol. 23A, Sep. 1992, pp. 2431-2435.
Timoshenko, S.P. & Goodler, J.N., "Theory of Elasticity", McGraw-Hill Classic Textbook Reissue 1934, pp. 8-11, 456-458.
Tomlinson, P.N. et al. "Syndax3 Pins-New Concepts in PCD Drilling," Rock Drilling, IDR 3/92, 1992 (pp. 109-114).
Ueda, Fumihiro, "Cutting performance of sintered diamond with MgCO3 as a sintering agent," Materials Science and Engineering, 1996 (pp. 260-263).
Yamane, T., et al., "Solid solubility of carbon in copper mechanically alloyed", Journal of Materials Science Letters 20 (2001), pp. 259-260.
U.S. Appl. No. 11/545,929, Aug. 13, 2008, Office Action.
U.S. Appl. No. 11/545,929, Jan. 21, 2009, Office Action.
U.S. Appl. No. 11/545,929, Aug. 27, 2009, Office Action.
U.S. Appl. No. 11/545,929, Apr. 15, 2010, Office Action.
U.S. Appl. No. 11/545,929, Jul. 21, 2010, Advisory Action.
U.S. Appl. No. 11/545,929, Mar. 20, 2012, Notice of Allowance.
U.S. Appl. No. 11/545,929, Jul. 18, 2012, Issue Notification.
U.S. Appl. No. 12/394,356, Sep. 1, 2011, Notice of Allowance.
U.S. Appl. No. 12/394,356, Nov. 30, 2011, Issue Notification.
U.S. Appl. No. 12/397,969, May 25, 2012, Notice of Allowance.
U.S. Appl. No. 12/397,969, Nov. 14, 2012, Issue Notification.
U.S. Appl. No. 12/548,584, May 18, 2012, Office Action.
U.S. Appl. No. 12/548,584, Oct. 24, 2012, Office Action.
U.S. Appl. No. 12/548,584, Jan. 3, 2013, Office Action.
U.S. Appl. No. 13/032,350, Mar. 14, 2013, Office Action.
U.S. Appl. No. 13/171,735, Aug. 17, 2012, Office Action.
U.S. Appl. No. 13/171,735, Jan. 24, 2013, Office Action.
U.S. Appl. No. 13/285,198, Feb. 5, 2013, Notice of Allowance.
U.S. Appl. No. 13/292,491, Feb. 11, 2013, Office Action.
U.S. Appl. No. 13/690,397, Feb. 14, 2013, Office Action.
U.S. Appl. No. 13/230,125, Jan. 18, 2013, Office Action.
U.S. Appl. No. 60/850,969, filed Oct. 10, 2006, Cooley et al.
U.S. Appl. No. 11/545,929, filed Oct. 10, 2006, Bertagnolli.
U.S. Appl. No. 60/860,098, filed Nov. 20, 2006, Sani.
U.S. Appl. No. 60/876,701, filed Dec. 21, 2006, Sani.
U.S. Appl. No. 12/120,849, filed May 15, 2008, Vail.
U.S. Appl. No. 12/363,104, filed Jan. 30, 2009, Sani.
Ekimov, E.A., et al. "Mechanical Properties and Microstructure of Diamond-SiC Nanocomposites" Inorganic Materials, vol. 38, No. 11, 2002, pp. 1117-1122.
PCT International Search Report and Written Opinion for PCT International Application No. PCT/US2007/024090; dated Apr. 15, 2008.
Declaration of Prior Sales of Terracut PDCS executed by Kenneth E. Bertagnolli Feb. 3, 2011.
Declaration of Prior Sales of Terracut PDCS executed by Paul D. Jones Feb. 3, 2011.
U.S. Appl. No. 11/983,619, May 26, 2010, Office Action.
U.S. Appl. No. 11/983,619, Aug. 9, 2010, Office Action.
U.S. Appl. No. 12/363,104, Oct. 14, 2010, Office Action.
U.S. Appl. No. 12/271,081, Dec. 22, 2010, Office Action.
U.S. Appl. No. 13/292,491, Aug. 8, 2012, Office Action.
U.S. Appl. No. 13/230,125, Jul. 11, 2012, Office Action.
U.S. Appl. No. 13/285,198, Jul. 11, 2012, Office Action.
U.S. Appl. No. 13/285,198, filed Oct. 31, 2011, Sani.
U.S. Appl. No. 13/230,125, filed Sep. 12, 2011, Sani.
U.S. Appl. No. 11/983,619, Sep. 21, 2011, Issue Notification.
U.S. Appl. No. 12/271,081, Oct. 5, 2011, Notice of Allowance.
U.S. Appl. No. 13/032,350, Nov. 26, 2012, Office Action.
U.S. Appl. No. 14/067,831, filed Oct. 30, 2013, Bertagnolli et al.
U.S. Appl. No. 12/548,584, Jun. 14, 2013, Office Action.
U.S. Appl. No. 12/548,584, Sep. 26, 2013, Office Action.
U.S. Appl. No. 13/032,350, Sep. 30, 2013, Office Action.
U.S. Appl. No. 13/100,388, Oct. 18, 2013, Office Action.
U.S. Appl. No. 13/171,735, Jul. 12, 2013, Office Action.
U.S. Appl. No. 13/230,125, Aug. 21, 2013, Issue Notification.
U.S. Appl. No. 13/285,198, Jul. 22, 2013, Notice of Allowance.
U.S. Appl. No. 13/285,198, Nov. 22, 2013, Notice of Allowance.
U.S. Appl. No. 13/292,491, Jul. 18, 2013, Office Action.
U.S. Appl. No. 13/292,491, Oct. 29, 2013, Office Action.
U.S. Appl. No. 13/027,954, Jul. 18, 2013, Office Action.
U.S. Appl. No. 13/027,954, Nov. 13, 2013, Office Action.
U.S. Appl. No. 13/690,397, Aug. 9, 2013, Office Action.
U.S. Appl. No. 13/690,397, Nov. 25, 2013, Office Action.
U.S. Appl. No. 13/917,952, Jul. 31, 2013, Office Action.
U.S. Appl. No. 13/917,952, Nov. 13, 2013, Office Action.
U.S. Appl. No. 13/292,900, Oct. 22, 2013, Notice of Allowance.
U.S. Appl. No. 13/292,900, Nov. 25, 2013, Notice of Allowance.
U.S. Appl. No. 13/323,138, Oct. 1, 2013, Office Action.
U.S. Appl. No. 13/323,138, Nov. 29, 2013, Notice of Allowance.
U.S. Appl. No. 13/953,453, Sep. 19, 2013, Office Action.
U.S. Appl. No. 13/953,453, Oct. 10, 2013, Office Action.
Decker, et al., "High-Pressure Calibration: A Critical Review," J. Phys. Chem. Ref. Data, 1, 3 (1972).
Rousse, et al. "Structure of the Intermediate Phase of PbTe at High Pressure," Physical Review B: Condensed Matter and Materials Physics, 71, 224116 (2005).
U.S. Appl. No. 14/178,118, filed Feb. 11, 2014, Mukhopadhyay et al.
U.S. Appl. No. 14/264,932, filed Apr. 29, 2014, Vail.
U.S. Appl. No. 12/548,584, Mar. 6, 2014, Notice of Allowance.
U.S. Appl. No. 13/032,350, Apr. 15, 2014, Notice of Allowance.
U.S. Appl. No. 13/100,388, Jan. 15, 2014, Office Action.
U.S. Appl. No. 13/171,735, Jan. 10, 2014, Office Action.
U.S. Appl. No. 13/171,735, May 7, 2014, Notice of Allowance.
U.S. Appl. No. 13/285,198, Apr. 11, 2014, Notice of Allowance.
U.S. Appl. No. 13/292,491, Mar. 21, 2014, Office Action.
U.S. Appl. No. 13/027,954, Mar. 10, 2014, Office Action.
U.S. Appl. No. 13/027,954, Jun. 3, 2014, Notice of Allowance.
U.S. Appl. No. 13/690,397, Mar. 12, 2014, Notice of Allowance.
U.S. Appl. No. 13/917,952, Feb. 26, 2014, Notice of Allowance.
U.S. Appl. No. 13/292,900, Jan. 30, 2014, Notice of Allowance.
U.S. Appl. No. 13/292,900, May 28, 2014, Issue Notification.
U.S. Appl. No. 13/323,138, Mar. 12, 2014, Notice of Allowance.
U.S. Appl. No. 13/953,453, Mar. 18, 2014, Office Action.
U.S. Appl. No. 13/917,952, Jun. 11, 2014, Issue Notification.
U.S. Appl. No. 13/953,453, filed Jul. 29, 2013, Sani.
U.S. Appl. No. 13/100,388, Apr. 13, 2015, Notice of Allowance.
U.S. Appl. No. 13/100,388, Apr. 22, 2015, Issue Notification.
U.S. Appl. No. 13/292,491, Apr. 15, 2015, Issue Notification.
U.S. Appl. No. 13/027,954, Apr. 8, 2015, Issue Notification.
U.S. Appl. No. 13/397,971, Mar. 19, 2015, Issue Notification.
U.S. Appl. No. 14/178,118, Sep. 22, 2015, Office Action.
U.S. Appl. No. 14/570,506, Sep. 15, 2015, Office Action.
U.S. Appl. No. 14/067,831, Jul. 15, 2015, Office Action.
U.S. Appl. No. 14/067,831, Oct. 26, 2015, Office Action.

(56) References Cited

OTHER PUBLICATIONS

U.S. Appl. No. 14/297,359, Oct. 30, 2015, Notice of Allowance.
U.S. Appl. No. 14/327,264, Nov. 6, 2015, Office Action.
U.S. Appl. No. 14/330,851, Nov. 12, 2015, Office Action.
ASTM B887-03 (2008) "Standard Test Method for Determination of Coercivity (Hcs) of Cemented Carbides".
ASTM B886-03 (2008), "Standard Test Method for Determination of Magnetic Saturation (Ms) of Cemented Carbides".
U.S. Appl. No. 14/570,506, filed Dec. 15, 2014, Miess et al.
U.S. Appl. No. 14/614,332, filed Feb. 8, 2015, Betragnolli et al.
U.S. Appl. No. 13/100,388, Nov. 7, 2014, Notice of Allowance.
U.S. Appl. No. 13/100,388, Dec. 24, 2014, Notice of Allowance.
U.S. Appl. No. 13/292,491, Nov. 3, 2014, Advisory Action.
U.S. Appl. No. 13/292,491, Dec. 19, 2014, Notice of Allowance.
U.S. Appl. No. 13/027,954, Dec. 26, 2014, Notice of Allowance.
U.S. Appl. No. 13/323,138, Nov. 25, 2014, Issue Notification.
U.S. Appl. No. 13/397,971, Nov. 26, 2014, Notice of Allowance.
U.S. Appl. No. 14/327,264, filed Jul. 9, 2014, Sani.
U.S. Appl. No. 14/330,851, filed Jul. 14, 2014, Sani.
U.S. Appl. No. 14/495,759, filed Sep. 24, 2014, Sani.
U.S. Appl. No. 14/504,253, filed Oct. 1, 2014, Bertagnolli et al.
U.S. Appl. No. 14/512,007, filed Oct. 10, 2014, Bertagnolli et al.
U.S. Appl. No. 12/548,584, Jun. 25, 2014, Issue Notification.
U.S. Appl. No. 13/032,350, Aug. 13, 2014, Issue Notification.
U.S. Appl. No. 13/100,388, Jun. 17, 2014, Notice of Allowance.
U.S. Appl. No. 13/100,388, Aug. 4, 2014, Notice of Allowance.
U.S. Appl. No. 13/171,735, Aug. 6, 2014, Issue Notification.
U.S. Appl. No. 13/285,198, Jul. 30, 2014, Issue Notification.
U.S. Appl. No. 13/292,491, Aug. 8, 2014, Office Action.
U.S. Appl. No. 13/027,954, Sep. 12, 2014, Notice of Allowance.
U.S. Appl. No. 13/690,397, Jul. 9, 2014, Issue Notification.
U.S. Appl. No. 13/323,138, Jul. 29, 2014, Notice of Allowance.
U.S. Appl. No. 13/397,971, Jun. 19, 2014, Office Action.
U.S. Appl. No. 13/953,453, Jun. 24, 2014, Notice of Allowance.
U.S. Appl. No. 14/621,019, filed Feb. 12, 2015, Jones et al.
U.S. Appl. No. 14/633,041, filed Feb. 26, 2015, Miess et al.
U.S. Appl. No. 14/634,395, filed Feb. 27, 2015, Miess et al.
U.S. Appl. No. 14/661,993, filed Mar. 18, 2015, Sani.
U.S. Appl. No. 13/100,388, Mar. 4, 2015, Notice of Allowance.
U.S. Appl. No. 13/953,453, Feb. 12, 2015, Notice of Allowance.
U.S. Appl. No. 13/953,453, Feb. 25, 2015, Issue Notification.
U.S. Appl. No. 14/178,118, Jan. 22, 2016, Office Action.
U.S. Appl. No. 14/570,506, Mar. 1, 2016, Office Action.
U.S. Appl. No. 14/327,264, Feb. 2, 2016, Notice of Allowance.
U.S. Appl. No. 14/495,759, Jan. 20, 2016, Office Action.
U.S. Appl. No. 14/514,007, Feb. 2, 2016, Office Action.
Clegg et al., "Faster, Longer, and More-Reliable Bit Runs With New-Generation PDC Cutter" SPE 102067, pp. 1-9, 2006.
U.S. Appl. No. 14/178,118, May 27, 2016, Advisory Action.
U.S. Appl. No. 14/178,118, Sep. 28, 2016, Office Action.
U.S. Appl. No. 14/570,506, Dec. 16, 2015, Interview Summary.
U.S. Appl. No. 14/570,506, May 25, 2016, Interview Summary.
U.S. Appl. No. 14/570,506, Aug. 10, 2016, Notice of Allowance.
U.S. Appl. No. 14/067,831, Apr. 7, 2016, Office Action.
U.S. Appl. No. 14/067,831, Aug. 25, 2016, Advisory Action.
U.S. Appl. No. 14/297,359, Mar. 14, 2016, Notice of Allowance.
U.S. Appl. No. 14/297,359, Jun. 15, 2016, Issue Notification.
U.S. Appl. No. 14/327,264, May 26, 2016, Notice of Allowance.
U.S. Appl. No. 14/327,264, Jun. 8, 2016, Issue Notification.
U.S. Appl. No. 14/330,851, Jul. 14, 2016, Office Action.
U.S. Appl. No. 14/495,759, May 25, 2016, Office Action.
U.S. Appl. No. 14/495,759, Oct. 3, 2016, Notice of Allowance.
U.S. Appl. No. 14/633,041, Apr. 11, 2016, Office Action.
U.S. Appl. No. 14/614,332, Jul. 1, 2016, Office Action.
U.S. Appl. No. 14/634,395, Jul. 29, 2016, Office Action.
U.S. Appl. No. 14/504,253, Aug. 25, 2016, Office Action.
U.S. Appl. No. 14/067,831, Jun. 14, 2017, Office Action.
U.S. Appl. No. 14/495,759, May 10, 2017, Issue Notification.
U.S. Appl. No. 14/634,395, Apr. 19, 2017, Issue Notification.
U.S. Appl. No. 14/621,019, May 19, 2017, Office Action.
U.S. Appl. No. 14/178,118, Mar. 24, 2017, Office Action.
U.S. Appl. No. 14/570,506, Mar. 17, 2017, Notice of Allowance.
U.S. Appl. No. 14/570,506, Mar. 29, 2017, Issue Notification.
U.S. Appl. No. 14/067,831, Jan. 20, 2017, Office Action.
U.S. Appl. No. 14/495,759, Feb. 8, 2017, Notice of Allowance.
U.S. Appl. No. 14/634,395, Jan. 26, 2017, Notice of Allowance.
U.S. Appl. No. 14/661,993, Feb. 16, 2017, Office Action.
U.S. Appl. No. 14/621,019, Mar. 30, 2017, Restriction Requirement.
U.S. Appl. No. 14/178,118, Jul. 28, 2017, Advisory Action.
U.S. Appl. No. 14/178,118, Oct. 6, 2017, Office Action.
U.S. Appl. No. 14/067,831, Dec. 19, 2017, Notice of Allowance.
U.S. Appl. No. 14/330,851, Aug. 10, 2017, Office Action.
U.S. Appl. No. 14/614,332, Jan. 13, 2017, Office Action.
U.S. Appl. No. 14/614,332, Aug. 15, 2017, Office Action.
U.S. Appl. No. 14/614,332, Jan. 18, 2018, Office Action.
U.S. Appl. No. 14/634,395, Jan. 11, 2017, Notice of Allowance.
U.S. Appl. No. 14/661,993, Jun. 22, 2017, Notice of Allowance.
U.S. Appl. No. 14/661,993, Oct. 18, 2017, Issue Notification.
U.S. Appl. No. 14/621,019, Dec. 26, 2017, Office Action.
U.S. Appl. No. 14/570,506, Nov. 22, 2016, Notice of Allowance.
U.S. Appl. No. 14/330,851, Dec. 29, 2016, Final Office Action.
U.S. Appl. No. 14/178,118, Jun. 15, 2018, Office Action.
U.S. Appl. No. 14/178,118, Sep. 25, 2018, Notice of Allowance.
U.S. Appl. No. 14/067,831, Apr. 4, 2018, Issue Notification.
U.S. Appl. No. 14/614,332, Jun. 6, 2018, Office Action.
U.S. Appl. No. 14/621,019, Aug. 10, 2018, Notice of Allowance.
U.S. Appl. No. 14/621,019, Nov. 28, 2018, Issue Notification.
U.S. Appl. No. 14/614,332, Jan. 25, 2019, Office Action.

* cited by examiner

METHOD OF PARTIALLY INFILTRATING AN AT LEAST PARTIALLY LEACHED POLYCRYSTALLINE DIAMOND TABLE AND RESULTANT POLYCRYSTALLINE DIAMOND COMPACTS

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process. The PDC cutting element may be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container or cartridge with a volume of diamond particles positioned on a surface of the cemented carbide substrate. A number of such cartridges may be loaded into an HPHT press. The substrate(s) and volume(s) of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a catalyst to promote intergrowth between the diamond particles, which results in formation of a matrix of bonded diamond grains having diamond-to-diamond bonding therebetween, with interstitial regions between the bonded diamond grains being occupied by the solvent catalyst.

The presence of the solvent catalyst in the PCD table is believed to reduce the thermal stability of the PCD table at elevated temperatures. For example, the difference in thermal expansion coefficient between the diamond grains and the solvent catalyst is believed to lead to chipping or cracking of the PCD table during drilling or cutting operations, which consequently can degrade the mechanical properties of the PCD table or cause failure. Additionally, some of the diamond grains can undergo a chemical breakdown or back-conversion to graphite via interaction with the solvent catalyst. At elevated high temperatures, portions of the diamond grains may transform to carbon monoxide, carbon dioxide, graphite, or combinations thereof, causing degradation of the mechanical properties of the PCD table.

One conventional approach for improving the thermal stability of PDCs is to at least partially remove the solvent catalyst from the PCD table of the PDC by acid leaching.

In another conventional approach for forming a PDC, a sintered PCD table may be separately formed and then leached to remove the solvent catalyst from interstitial regions between bonded diamond grains. The leached PCD table may be simultaneously HPHT bonded to a cemented carbide substrate and infiltrated with silicon and cobalt from the substrate in a separate HPHT process. The silicon may infiltrate the interstitial regions of the leached PCD table from which the solvent catalyst has been leached and react with the diamond grains to form silicon carbide. The cobalt may also infiltrate the interstitial regions of the leached PCD table from which the solvent catalyst has been leached to form a bond with the cemented carbide substrate. PDCs sold under the trade name Terracut were fabricated by the foregoing process.

Despite the availability of a number of different PDCs, manufacturers and users of PDCs continue to seek PDCs that exhibit improved toughness, wear resistance, thermal stability, or combinations thereof.

SUMMARY

Embodiments of the invention relate to methods of manufacturing PDCs by infiltrating an at least partially leached PCD table in a controlled manner in an HPHT process, and resultant PDCs. The temperature, pressure, and HPHT process time are chosen to control a depth to which an infiltrant partially infiltrates into the at least partially leached PCD table in the HPHT process.

In an embodiment, a method of fabricating a PDC includes forming a PCD table in the presence of a metal-solvent catalyst in a first HPHT process. The PCD table so formed includes a plurality of bonded diamond grains defining a plurality of interstitial regions, with at least a portion of the plurality of interstitial regions including the metal-solvent catalyst disposed therein. The plurality of bonded diamond grains exhibits an average grain size of about 40 μm or less. The method further includes at least partially leaching the PCD table to remove at least a portion of the metal-solvent catalyst therefrom. The method additionally includes subjecting the at least partially leached PCD table and a substrate to a second HPHT process under diamond-stable temperature-pressure conditions to partially infiltrate the at least partially leached PCD table with an infiltrant and attach the partially infiltrated PCD table to the substrate. A maximum temperature (T), a total process time (t), and a maximum internal cell pressure (P) of the second HPHT process are chosen so that β is about 2 to about 325° Celsius·hours/gigapascals ("° C.·h/GPa"), with β represented as $\beta = T \cdot t / P$. The infiltrated polycrystalline diamond table includes a first region adjacent to the substrate including the infiltrant disposed in at least a portion of the interstitial regions thereof and a second region extending inwardly from an exterior working surface to a selected depth of at least about 700 μm. The second region is substantially free of the infiltrant.

In an embodiment, a PDC includes a substrate, and a pre-sintered PCD table bonded to the substrate. The pre-sintered PCD table includes an exterior working surface, at least one lateral surface, and a chamfer extending between the exterior working surface and the at least one lateral surface. The pre-sintered PCD table includes a plurality of bonded diamond grains defining a plurality of interstitial regions. The plurality of bonded diamond grains exhibits an average grain size of about 40 μm or less. The pre-sintered PCD table further includes a first region and a second region. The first region is adjacent to the substrate, and at least a portion of the interstitial regions of the first region include an infiltrant disposed therein. The second region is adjacent to the first region and extends inwardly from the exterior working surface to a selected depth of at least about 700 μm. The interstitial regions of the second region are substantially free of the infiltrant. A nonplanar interface is located between the first and second regions.

Other embodiments include applications utilizing the disclosed PDCs in various articles and apparatuses, such as, rotary drill bits, bearing apparatuses, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical elements or features in different views or embodiments shown in the drawings.

DETAILED DESCRIPTION

Embodiments of the invention relate to methods of manufacturing PDCs by infiltrating an at least partially leached PCD table in a controlled manner in an HPHT process, and resultant PDCs. The temperature, pressure, and HPHT process time are chosen to control a depth to which an infiltrant partially infiltrates into the at least partially leached PCD table in the HPHT process. The disclosed PDCs may be used in a variety of applications, such as rotary drill bits, machining equipment, and other articles and apparatuses.

Figure 1:
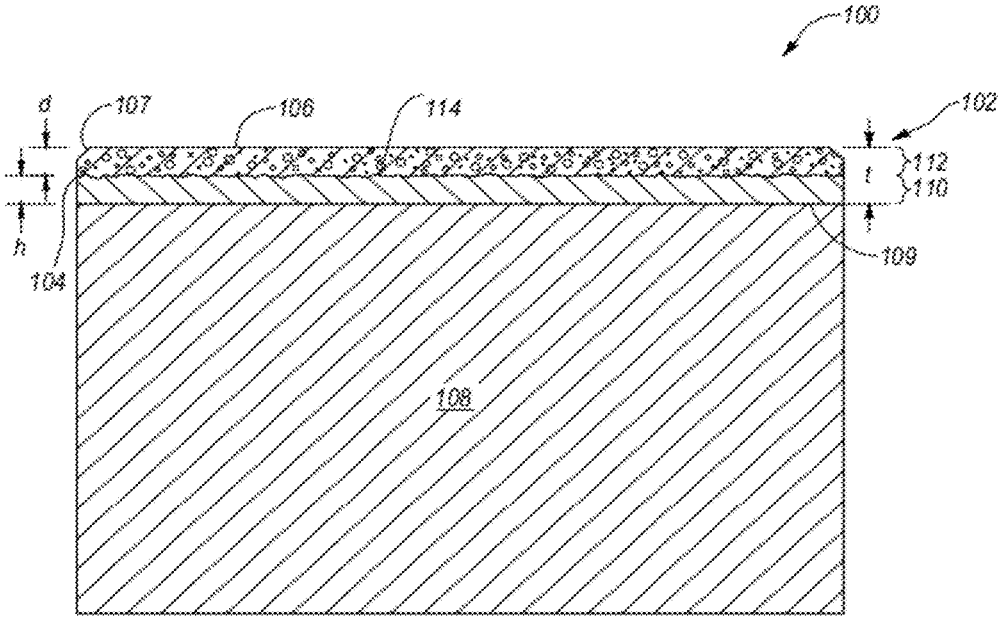
FIG. 1 is a cross-sectional view of an embodiment of a PDC including a partially infiltrated PCD table attached to a cemented carbide substrate.

FIG. 1 is a cross-sectional view of an embodiment of a PDC 100 including a partially infiltrated pre-sintered PCD table 102 attached to a cemented carbide substrate 108 along an interfacial surface 109 thereof. The PCD table 102 includes a plurality of directly bonded-together diamond grains exhibiting diamond-to-diamond bonding (e.g., $sp^3$ bonding) therebetween, which define a plurality of interstitial regions. The PCD table 102 includes at least one lateral surface 104, an upper exterior working surface 106, and an optional chamfer 107 extending therebetween. It is noted that at least a portion of the at least one lateral surface 104 and/or the chamfer 107 may also function as a working surface that contacts a subterranean formation during drilling operations. Additionally, although the interfacial surface 109 is illustrated as being substantially planar, in other embodiments, the interfacial surface 109 may exhibit a selected nonplanar topography, with the PCD table 102 exhibiting a correspondingly configured nonplanar interfacing topography.

The diamond grains of the PCD table 102 may exhibit an average grain size of about 40 μm or less, such as about 30 μm or less, about 25 μm or less, or about 20 μm or less. For example, the average grain size of the diamond grains may be about 10 μm to about 18 μm, about 8 μm to about 15 μm, about 9 μm to about 12 μm, or about 15 μm to about 18 μm. In some embodiments, the average grain size of the diamond grains may be about 10 μm or less, such as about 2 μm to about 5 μm or submicron. The diamond grain size distribution of the diamond grains may exhibit a single mode, or may be a bimodal or greater grain size distribution.

The PCD table 102 exhibits a thickness "t" of at least about 0.040 inch, such as about 0.045 inch to about 0.100 inch, about 0.050 inch to about 0.090 inch, about 0.065 inch to about 0.080 inch, or about 0.070 inch to about 0.080 inch. The infiltrated polycrystalline diamond table 102 includes a first region 110 adjacent to the substrate 108 that extends from the interfacial surface 109 an average selected infiltration distance "h" and includes an infiltrant disposed in at least a portion of the interstitial regions thereof. The infiltrant may be chosen from iron, nickel, cobalt, and alloys of the foregoing metals. For example, the infiltrant may be provided from the substrate 108 (e.g., a cobalt from a cobalt-cemented carbide substrate) or provided from another source such as a metallic foil and/or powder. The PCD table 102 includes a second region 112 that extends inwardly from the working surface 106 to an average selected depth "d." The depth "d" may be at least about 700 μm, about 700 μm to about 2100 μm, about 750 μm to about 2100 μm, about 750 μm to about 1500 μm, about 1000 μm to about 1750 μm, about 1000 μm to about 2000 μm, about 1500 μm to about 2000 μm, about a third of the thickness of the PCD table 102, about half of the thickness of the PCD table 102, or about more than half of the thickness of the PCD table 102. The interstitial regions of the second region 112 are substantially free of the infiltrant.

As the PCD table 102 was fabricated from an at least partially leached PCD table that was subsequently partially infiltrated with the infiltrant, the second region 112 may still include some residual metal-solvent catalyst used to initially form the diamond-to-diamond bonds in the PCD table 112 that was not removed in the leaching process. For example, the residual metal-solvent catalyst in the interstitial regions of the second region 112 may be about 0.5% to about 2% by weight, such as about 0.9% to about 1% by weight. Even with the residual amount of the metal-solvent catalyst in the second region 112, the interstitial regions of the second region 112 may be considered to be substantially void of material.

The substrate 108 comprises a plurality of tungsten carbide or other carbide grains (e.g., tantalum carbide, vanadium carbide, niobium carbide, chromium carbide, and/or titanium carbide) cemented together with a metallic cementing constituent, such as cobalt, iron, nickel, or alloys thereof. For example, in an embodiment, the cemented carbide substrate is a cobalt-cemented tungsten carbide substrate. In some embodiments, the substrate 108 may include two or more different carbides (e.g., tungsten carbide and titanium carbide).

The inventors currently believe that the infiltration depth "h" is primarily governed by capillary action, which depends heavily on the viscosity, surface energy, and contact angle of the infiltrant (e.g., cobalt), as well as the time period over which the HPHT conditions are maintained. For example, according to one theory, the infiltration depth "h" is approximated by the mathematical expression below:

$$h = \frac{2}{\pi}\left[rt\gamma\frac{\mathrm{Cos}\vartheta}{2\upsilon}\right]^{\frac{1}{2}}$$

where:

h=infiltration depth;

r=radius of the interstitial regions of the PCD table 102;

t=time;

θ=contact angle of the infiltrant with the at least partially leached PCD table 102;

γ=surface energy of the infiltrant; and

υ=viscosity (which depends on temperature and pressure) of the infiltrant.

According to one theory, the porosity of the PCD table 102 draws the infiltrant further into the PCD table 102 as a result of capillary action. The infiltration depth "h" is not simply a function of pressure, as increased pressure would be expected to drive more complete penetration of the infiltrant through the PCD table 102. Rather, as shown by working examples 1-4 below, infiltration depth "h" appears to be governed by capillary action so that at a given pressure for which substantially full infiltration occurs, higher pressures (and the same temperature and HPHT process time) will result in less infiltration. According to one theory, infiltration occurs through capillary action rather than a pressure differential. The viscosity of the infiltrant increases at increased pressures, causing less infiltration to occur than at lower pressures, all else being equal. Viscosity is also affected by temperature, i.e., as temperature increases, viscosity decreases, so that at higher temperatures, increased infiltration results. Infiltration may also be affected by process time. Increased processing times result in increased depth of infiltration.

The temperature, pressure, and time period during the HPHT process used for attachment of the PCD table 102 to the substrate 108 may be controlled so as to provide for a desired infiltration depth "h." Partial infiltration of the PCD table 102 may provide the same or better wear resistance and/or thermal stability characteristics of a leached PCD table integrally formed on a substrate (i.e., a one-step PDC) without actual leaching having to be performed, as the infiltrant does not fully infiltrate to the working surface 106 of the PCD table 102. Examples of such an embodiment are described in working examples 3 and 4, below. In some embodiments, the PCD table 102 may be leached to remove a portion of the infiltrant from the first region 110 to improve the uniformity of infiltrant in the first region 110, thermal stability, wear resistance, or combinations of the foregoing. Examples of such embodiments are described in working examples 5-7, below.

It is noted that an irregular nonplanar interface 114 is present between the first region 110 and the second region 112. One effect of this characteristic is that this nonplanar interface 114 between the first region 110 and the second region 112 differs from an otherwise similarly appearing PDC, but in which a region similar to second region 112 (in that it is substantially void of infiltrant) is formed by leaching, particularly if the PCD table 102 includes a chamfer formed therein. In such instances, the leaching profile advances from the outer surfaces exposed to the leaching acid. For example, leaching typically progresses from the exterior surfaces downward and/or inward so that any chamfer or end exposed to the acid affects the leaching profile. The incomplete infiltration operates by a different mechanism in which infiltration occurs from the "bottom up," so that the presence of the chamfer 107 in the PCD table 102 does not affect the infiltration profile of the infiltrant. Additionally, if the infiltrant had infiltrated the entire PCD table 102 so that the interstitial regions of the second region 112 were also occupied by the infiltrant and subsequently removed in a leaching process to the depth "d," a boundary between the first region 110 and the second region 112 would be indicative of being defined by a leaching process as opposed to being relatively irregular.

As will be discussed in more detail below, the PCD table 102 is formed separately from the substrate 108, and the PCD table 102 is subsequently attached to the substrate 108. For example, in an embodiment, the PCD table 102 may be integrally formed with a first cemented carbide substrate, after which the first substrate is removed, the separated PCD table is at least partially leached, and the at least partially leached PCD table is then attached to the substrate 108 in a second HPHT process. In another embodiment, the PCD table 102 may be formed without using a cemented carbide substrate (e.g., by subjecting diamond particles and a metal-solvent catalyst to a HPHT process), after which the formed PCD table is at least partially leached and attached to the substrate 108.

When attaching the PCD table 102 to substrate 108 in a second HPHT process, the HPHT process conditions (e.g., maximum temperature, maximum pressure, and total process time) are specifically chosen to result in only partial infiltration of the PCD table 102. As a result of this second HPHT process, the infiltrant within the substrate 108 (e.g., cobalt from a cobalt-cemented tungsten carbide) infiltrates from the substrate 108 into at least some of the interstitial regions of PCD table 102 in the first region 110.

Figure 2:
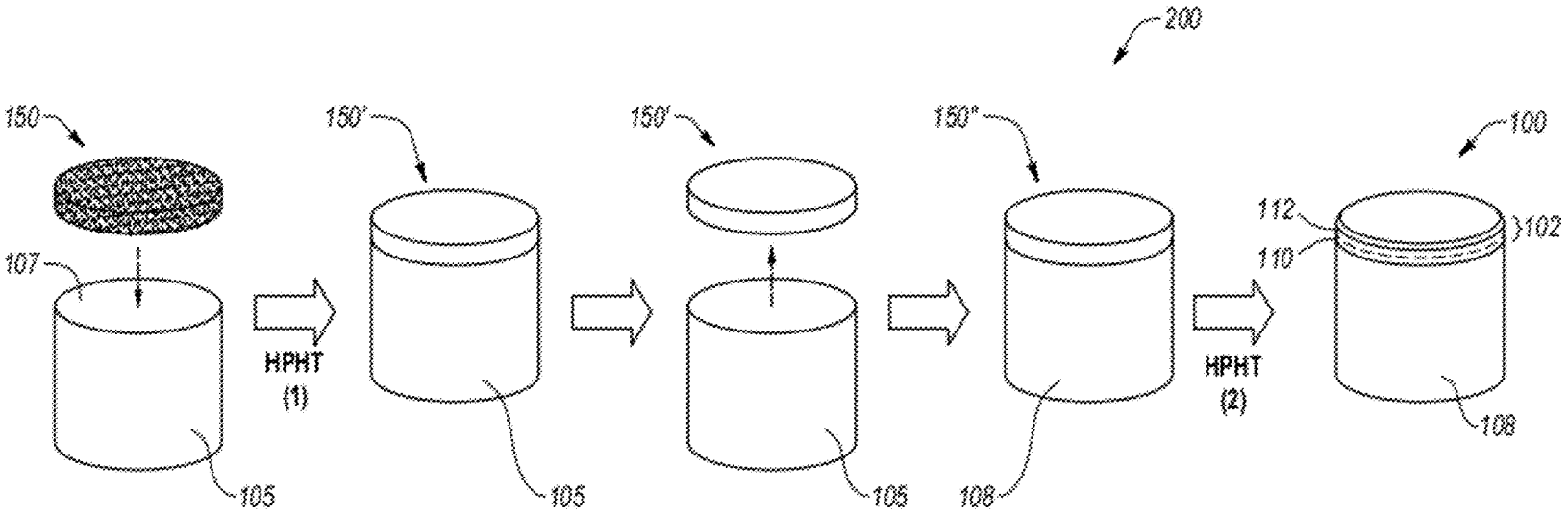
FIG. 2 is a schematic illustration of an embodiment of a method for fabricating the PDC shown in FIG. 1.

FIG. 2 is a schematic illustration of an embodiment of a method for fabricating the PDC 100 shown in FIG. 1. The plurality of diamond particles of the one or more layers of diamond particles 150 may be positioned adjacent to an interfacial surface 107 of a first cemented carbide substrate 105.

In an embodiment, the diamond particles of the one or more layers of diamond particles 150 may exhibit an average particle size of about 40 μm or less, such as about 30 μm or less, about 25 μm or less, or about 20 μm or less. For example, the average particle size of the diamond particles may be about 10 μm to about 18 μm, about 8 μm to about 15 μm, about 9 μm to about 12 μm, or about 15 μm to about 18 μm. In some embodiments, the average particle size of the diamond particles may be about 10 μm or less, such as about 2 μm to about 5 μm or submicron.

The diamond particle size distribution of the diamond particle may exhibit a single mode, or may be a bimodal or greater grain size distribution. In an embodiment, the diamond particles of the one or more layers of diamond particles 150 may comprise a relatively larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the diamond particles may include a portion exhibiting a relatively larger average particle size (e.g., 50 μm, 40 μm, 30 μm, 20 μm, 15 μm, 12 μm, 10 μm, 8 μm) and another portion exhibiting at least one relatively smaller average particle size (e.g., 6 μm, 5 μm, 4 μm, 3 μm, 2 μm, 1 μm, 0.5 μm, less than 0.5 μm, 0.1 μm, less than 0.1 μm). In an embodiment, the diamond particles may include a portion exhibiting a relatively larger average particle size between about 10 μm and about 40 μm and another portion exhibiting a relatively smaller average particle size between about 1 μm and 4 μm. In some embodiments, the diamond particles may comprise three or more different average particle sizes (e.g., one relatively larger average particle size and two or more relatively smaller average particle sizes), without limitation.

It is noted that the as-sintered diamond grain size may differ from the average particle size of the diamond particles prior to sintering due to a variety of different physical processes, such as grain growth, diamond particles fracturing, carbon provided from another carbon source (e.g., dissolved carbon in the metal-solvent catalyst), or combinations of the foregoing.

The first cemented carbide substrate 105 and the one or more layers of diamond particles 150 may be placed in a pressure transmitting medium, such as a refractory metal can embedded in pyrophyllite or other pressure transmitting medium. The pressure transmitting medium, including the first cemented carbide substrate 105 and the one or more layers of diamond particles 150 therein, may be subjected to a first HPHT process using an ultra-high pressure press to create temperature and pressure conditions at which diamond is stable. The temperature of the first HPHT process may be at least about 1000° C. (e.g., about 1200° C. to about 1600° C.) and the pressure of the first HPHT process may be at least 4.0 GPa (e.g., about 5.0 GPa to about 12.0 GPa) for a time sufficient to sinter the diamond particles to form the PCD table 150'. For example, the pressure of the first HPHT process may be about 5 GPa to about 7 GPa and the temperature of the first HPHT process may be about 1150° C. to about 1450° C. (e.g., about 1200° C. to about 1400° C.).

During the first HPHT process, the metal-solvent catalyst cementing constituent from the first cemented carbide substrate 105 may be liquefied and may infiltrate into the diamond particles of the one or more layers of diamond particles 150. The infiltrated metal-solvent catalyst cementing constituent functions as a catalyst that catalyzes initial formation of directly bonded-together diamond grains to form the PCD table 150'.

In an alternative to using the first cemented carbide substrate 105 during sintering of the diamond particles, the PCD table 150' may be formed by placing the diamond particles along with a metal-solvent catalyst (e.g., cobalt powder and/or a cobalt disc) in a pressure transmitting medium, such as a refractory metal can embedded in pyrophyllite or other pressure transmitting medium. The pressure transmitting medium, including the diamond particles and metal-solvent catalyst therein, may be subjected to a first HPHT process using an ultra-high pressure press to create temperature and pressure conditions at which diamond is stable. Such a process will result in the formation of a PCD table 150' separate from any cemented carbide substrate 105.

In embodiments in which the PCD table 150' is formed so as to be metallurgically bonded to a cemented carbide substrate, the PCD table 150' may then be separated from the first cemented carbide substrate 105, as shown in FIG. 2. For example, the PCD table 150' may be separated from the first cemented carbide substrate 105 by grinding and/or lapping away the first cemented carbide substrate 105, electrodischarge machining, or combinations of the foregoing material removal processes.

Whether the first cemented carbide substrate 105 is employed during formation of the PCD table 150' or not, the metal-solvent catalyst may be at least partially removed from the PCD table 150' by immersing the PCD table 150' in an acid, such as aqua regia, nitric acid, hydrofluoric acid, mixtures thereof, or other suitable acid, to form a porous at least partially leached PCD table 150" that allows fluid to flow therethrough (e.g., from one side to another side). For example, the PCD table 150' may be immersed in the acid for about 2 to about 7 days (e.g., about 3, 5, or 7 days) or for a few weeks (e.g., about 4-6 weeks) depending on the process employed. In some embodiments, a residual amount of the metal-solvent catalyst used to catalyze formation of the diamond-to-diamond bonds of the PCD table 150' may still remain even after leaching. For example, the residual metal-solvent catalyst in the interstitial regions may be about 0.5% to about 2% by weight, such as about 0.9% to about 1% by weight.

In embodiments employing the cemented carbide substrate 105, it is noted that because the metal-solvent catalyst is infiltrated into the diamond particles from the cemented carbide substrate 105 including tungsten carbide or other carbide grains cemented with a metal-solvent catalyst (e.g., cobalt, nickel, iron, or alloys thereof), the infiltrated metal-solvent catalyst may carry tungsten therewith, tungsten carbide therewith, another metal therewith, another metal carbide therewith, or combinations of the foregoing. In such embodiments, the PCD table 150' and the at least partially leached PCD table 150" may include such material(s) disposed interstitially between the bonded diamond grains. The tungsten therewith, tungsten carbide therewith, another metal therewith, another metal carbide therewith, or combinations of the foregoing may be at least partially removed by the selected leaching process or may be relatively unaffected by the selected leaching process.

As shown in FIG. 2, the PCD table 150" is placed with the substrate 108 to which the PCD table 150" is to be attached to form an assembly 200. The assembly 200 may be placed in a pressure transmitting medium, such as a refractory metal can embedded in pyrophyllite or other pressure transmitting medium. The pressure transmitting medium, including the assembly 200, may be subjected to a second HPHT process using an ultra-high pressure press to create temperature and pressure conditions at which diamond is stable. The temperature of the second HPHT process may be at least about 1000° C. (e.g., about 1200° C. to about 1600° C.) and the pressure of the second HPHT process may be at least 5.0 GPa (e.g., about 5.0 GPa to about 12.0 GPa) so that the infiltrant (e.g., the metallic cementing constituent) in the cemented carbide substrate 108 is liquefied and infiltrates into the PCD table 150". Upon cooling from the second HPHT process, the partially infiltrated PCD table 102 is bonded to the cemented carbide substrate 108.

As an alternative to using the cemented carbide substrate 108 as an infiltrant source, an infiltrant layer (e.g., a cobalt disc) may be disposed between the cemented carbide substrate 108 and the PCD table 150". In such an embodiment, the infiltrant layer may liquefy and infiltrate into the PCD table 150" during the second HPHT process.

The infiltration depth "h" may be controlled by selection of the maximum temperature, maximum pressure, and total process time of the second HPHT process during which the PCD table 150" attaches to substrate 108. As used herein, total process time includes the time to ramp-up to the maximum temperature, the soak time at the maximum temperature, and the cool down time from the maximum temperature. The second HPHT process conditions are controlled so that the infiltrant from the substrate 108 only partially infiltrates the PCD table 150" to form the PCD table 102 having the first region 110 and the second region 112, respectively in which the interstitial regions of the second region 112 remain unfilled by the infiltrant infiltrated from the substrate 108.

An HPHT process parameter β may be defined to characterize the second HPHT process during which the PCD table 150" attaches to substrate 108. β is defined as $\beta = T \cdot t/P$, where:

T is a maximum temperature of the second HPHT process;

t is the total process time (t) of the second HPHT process; and

P is a maximum internal cell pressure in the pressure transmitting medium used in the second HPHT process.

β may be about 2° C.·h/GPa to about 325° C.·h/GPa, about 5° C.·h/GPa to about 100° C.·h/GPa, about 5° C.·h/GPa to about 35° C.·h/GPa, about 7.5° C.·h/GPa to about 25° C.·h/GPa, about 10° C.·h/GPa to about 20° C.·h/GPa, about 20° C.·h/GPa to about 30° C.·h/GPa (e.g., 24-26° C.·h/GPa), about greater than 28° C.·h/GPa, about 30° C.·h/GPa to about 100° C.·h/GPa, about 50° C.·h/GPa to about 75° C.·h/GPa, about 75° C.·h/GPa to about 150° C.·h/GPa, or about 100° C.·h/GPa to about 200° C.·h/GPa. By controlling T, t, and P of the second HPHT process, the infiltration depth "h" may be controlled so that the PCD table 150" is only partially infiltrated. For a given thickness of the PCD table 150", the infiltration depth "h" may be decreased by increasing P, decreasing T, decreasing t, or combinations thereof. Thus, for a given thickness of the PCD table 150", the infiltration depth "h" may be decreased by decreasing β and increased by increasing β.

In the second HPHT process, in some embodiments, P is about 6 GPa to about 10 GPa, T is about 1250° C. to about 3250° C., and t is about 60 seconds to about 1 hour. In other more specific embodiments for the second HPHT process that will result in partial infiltration of a 3.5-5 mm thick PCD table 150", P is about 6 GPa to about 8 GPa (e.g., about 6.1 GPa to about 7.0 GPa), T is about 1250° C. to about 1500° C., and t is about 60 seconds to about 7 minutes (e.g., about 200-450 seconds) that results in the depth "d" of the second region 112 of the PCD table 102 being at least about a third of the PCD table thickness, about half of the PCD table thickness, or more than half of the PCD table thickness. The time (t) for the second HPHT process is typically longer when a high-pressure belt press is used to apply pressure as opposed to a high-pressure cubic press. Typical times used with a high-pressure cubic pressure are about 200-450 seconds, such as about 300-400 seconds of total process time.

The inventors have unexpectedly found that increasing the pressure (P) during the second HPHT process results in decreased infiltration. As explained above, one theory is infiltration occurs through capillary action, and that the increased pressure (P) increases the viscosity of the infiltrant, allowing the infiltrant to infiltrate into the PCD table 150" a relatively less extent than if a higher pressure (P) is employed. For example, in an embodiment the first HPHT process may be carried out at a pressure of about 6 GPa, while in order to achieve partial infiltration, the second HPHT process may be carried out at a pressure between about 6.2 GPa and about 10 GPa (e.g., about 6.3 GPa to about 8.5 GPa, or about 6.3 GPa to about 7 GPa). The temperature and time period of the first and second processes may otherwise be the same (e.g., 1400° C. for about 400 seconds). Higher pressures may be employed to further decrease the infiltration depth "h" for a given temperature (T), time (t), and thickness of the PCD table 150". In other words, as the pressure (P) increases, the infiltration will be less complete.

In a similar manner, the temperature (T) may be altered from the first process to the second process to achieve a similar result. For example, a decrease in temperature (T) provides a similar effect relative to infiltration depth "h" as an increase in pressure (P). Processing time (t) may also be altered from the first process to the second process to achieve a desired infiltration depth "h". For example, increasing processing time (t) provides a similar effect relative to infiltration depth "h" as a decrease in pressure (P). More than one of the temperature (T), pressure (P), or processing time (t) variables may be changed to achieve a desired infiltration depth "h" and any of the resultant selected depths "d" disclosed herein.

In some embodiments, at least one of the P, T, or t in the second HPHT process are different than an associated P, T, or t used in the first HPHT process used to initially sinter the diamond particles that forms the PCD table 150'.

In some embodiments, the infiltrant that occupies the interstitial regions of the first region 110 of the PCD table 102 may be at least partially removed in a subsequent leaching process using an acid, such as aqua regia, nitric acid, hydrofluoric acid, mixtures thereof, or other suitable acid. Even though the second region 112 is already substantially free of the infiltrant, the inventors have found that leaching may improve the uniformity of the interface 114 between the first region 110 and the second region 112, which may improve thermal stability and/or wear resistance in the finished PDC 100.

The following working examples provide further detail in connection with the specific PDC embodiments described above.

Comparative Example A

A PDC was formed according to the following process. A layer of diamond particles was placed adjacent to a cobalt-cemented tungsten carbide substrate. The diamond particles and the substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the substrate. The thickness of the PCD table of the PDC was about 0.083 inch and an about 0.012 inch chamfer was machined in the PCD table.

Figure 7:
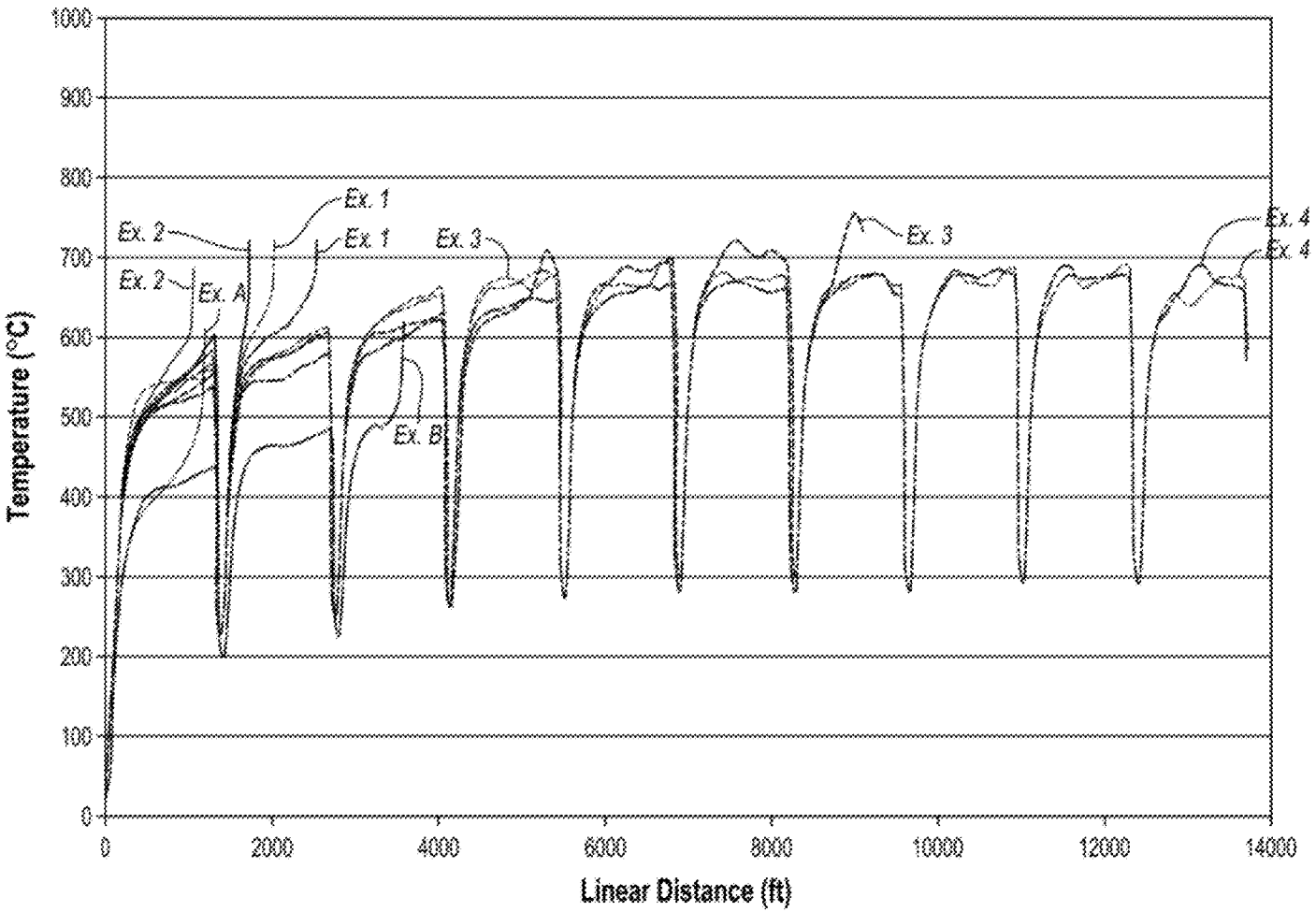
FIG. 7 is a graph showing the measured temperature versus linear distance cut during a vertical turret lathe test on some conventional PDCs and several unleached PDCs according to working examples 1-4 of the present invention.

The thermal stability of the conventional unleached PDC so-formed was evaluated by measuring the distance cut in a Sierra White granite workpiece prior to failure without using coolant in a vertical turret lathe test. The distance cut is considered representative of the thermal stability of the PDC. The conventional unleached PDC was able to cut a distance of only about 1000 linear feet in the workpiece prior to failure. The test parameters were a depth of cut for the PDC of about 1.27 mm, a back rake angle for the PDC of about 20 degrees, an in-feed for the PDC of about 1.524 mm/rev, and a cutting speed of the workpiece to be cut of about 1.78 m/sec. Evidence of failure of the conventional unleached PDC is best shown in FIG. 7 where the measured temperature of the conventional unleached PDC during cutting increased dramatically at about 1000 linear feet.

Comparative Example B

A PDC was formed according to the following process. A layer of diamond particles having the same particle size distribution as comparative example A was placed adjacent to a cobalt-cemented tungsten carbide substrate. The diamond particles and the substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the substrate. The PCD table was subsequently leached to remove cobalt from the interstitial regions between diamond grains within the PCD table to a depth of about 94 μm. The thickness of the PCD table of the PDC was about 0.088 inches and an about 0.012 inch chamfer was machined in the PCD table.

The thermal stability of the conventional leached PDC so-formed was evaluated by measuring the distance cut in the same Sierra White granite workpiece as Comparative Example A prior to failure without using coolant in a vertical turret lathe test and using the same test parameters. The distance cut is considered representative of the thermal stability of the PDC. The conventional leached PDC was able to cut a distance of about 3500 linear feet in the workpiece prior to failure. Evidence of failure of the conventional PDC is best shown in FIG. 7 where the measured temperature of the conventional PDC during cutting increased dramatically at about 3500 linear feet.

Working Example 1

Figure 3:
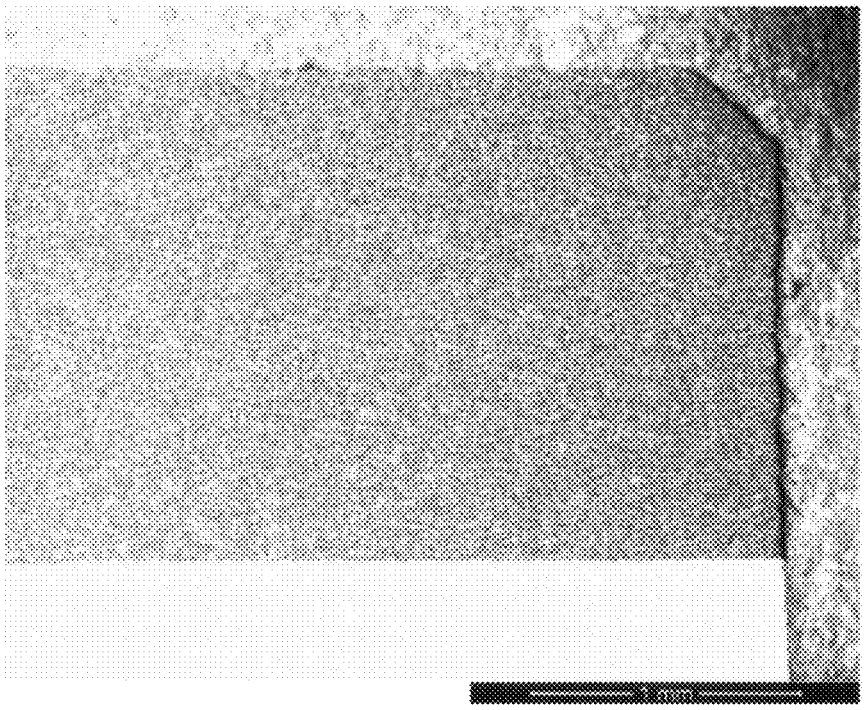
FIG. 3 is a photomicrograph of a PCD table of a PDC formed according to working example 1 of the present invention.

Two PDCs were formed according to the following process. A layer of diamond particles having the same particle size distribution as comparative example A was placed adjacent to a first cobalt-cemented tungsten carbide substrate. The diamond particles and the first cobalt-cemented tungsten carbide substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the first cobalt-cemented tungsten carbide substrate. The PCD table was then separated from the first cobalt-cemented tungsten carbide substrate by grinding away the first cemented tungsten carbide substrate. The PCD table was subsequently leached to remove substantially all of the cobalt from the interstitial regions between diamond grains within the PCD table. The leached PCD table was then placed adjacent to a second cobalt-cemented tungsten carbide substrate. The PCD table and the second cobalt-cemented tungsten carbide substrate were positioned within a pyrophyllite cube, and HPHT processed at a temperature of about 1400° C. and a pressure of about 5.1 GPa for about 250 seconds of soak time (about 400 seconds total process time) at the 1400° C. in a high-pressure cubic press to attach the PCD table to the second tungsten carbide substrate. A scanning electron microscope image (FIG. 3) of the PDC so-formed showed substantially complete infiltration of cobalt from the second cobalt-cemented tungsten carbide substrate into the PCD table.

The thickness of the PCD table of one PDC was about 0.079 inch and an about 0.012 inch chamfer was machined in the PCD table. The thickness of the PCD table of the other PDC was about 0.080 inch and an about 0.013 inch chamfer was machined in the PCD table.

The thermal stability of the unleached PDCs so-formed was evaluated by measuring the distance cut in the same Sierra White granite workpiece as Comparative Example A prior to failure without using coolant in a vertical turret lathe test using the same test parameters. The distance cut is considered representative of the thermal stability of the PDC. One of the unleached PDCs was able to cut a distance of about 2000 linear feet in the workpiece prior to failure. The other unleached PDC was able to cut a distance of about 2500 linear feet in the workpiece prior to failure. Evidence of failure of each PDC is best shown in FIG. 7 where the measured temperature of each PDC during cutting increased dramatically at about 2000 and 2500 linear feet for the two PDCs, respectively.

Working Example 2

Figure 4:
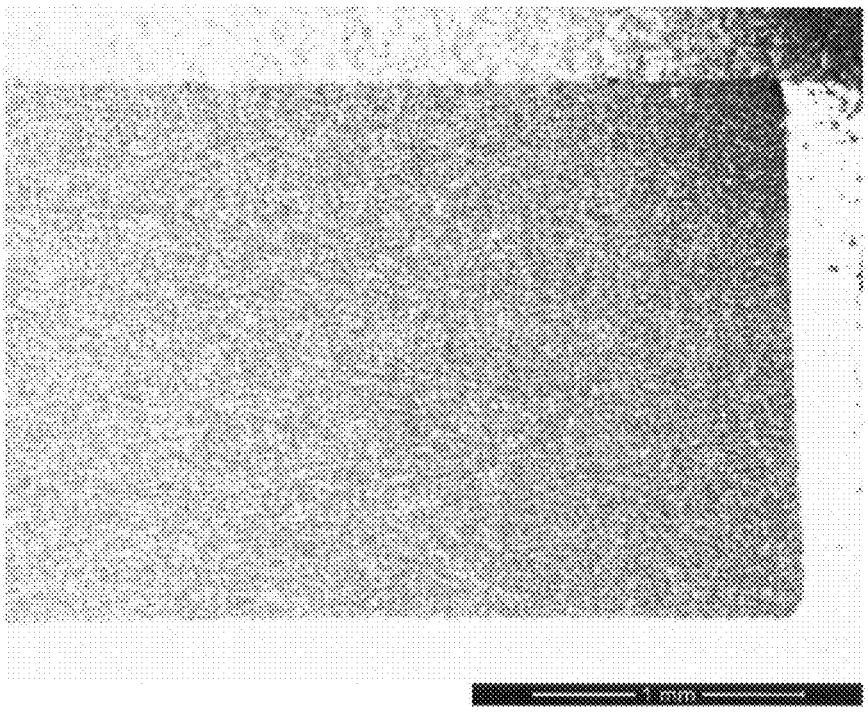
FIG. 4 is a photomicrograph of a PCD table of a PDC formed according to working example 2 of the present invention.

Two PDCs were formed according to the following process. A layer of diamond particles having the same particle size distribution as comparative example A was placed adjacent to a first cobalt-cemented tungsten carbide substrate. The diamond particles and the first cobalt-cemented tungsten carbide substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the first cobalt-cemented tungsten carbide substrate. The PCD table was then separated from the first tungsten carbide substrate by grinding away the first cemented tungsten carbide substrate. The PCD table was leached to remove substantially all of the cobalt from the interstitial regions between diamond grains within the PCD table. The leached PCD table was then placed adjacent to a second cobalt-cemented tungsten carbide substrate. The PCD table and the second cobalt-cemented tungsten carbide substrate were positioned within a pyrophyllite cube, and HPHT processed at a temperature of about 1400° C. and a pressure of about 5.7 GPa for about 250 seconds of soak time (about 400 seconds total process time) at the 1400° C. temperature in a high-pressure cubic press to attach the PCD table to the second cobalt-cemented tungsten carbide substrate. A scanning electron microscope image (FIG. 4) of the PDC so-formed showed substantially complete infiltration of cobalt from the second cobalt-cemented tungsten carbide substrate into the PCD table.

The thickness of the PCD table of the first PDC was about 0.081 inch and an about 0.012 inch chamfer was machined in the PCD table. The thickness of the PCD table of the second PDC was about 0.079 inch and an about 0.012 inch chamfer was machined in the PCD table.

The thermal stability of the unleached PDC so-formed was evaluated by measuring the distance cut in the same Sierra White granite workpiece as Comparative Example A prior to failure without using coolant in a vertical turret lathe test and using the same test parameters. The distance cut is considered representative of the thermal stability of the PDC. One of the unleached PDCs was able to cut a distance of about 1000 linear feet in the workpiece prior to failure. The other was able to cut a distance of about 2000 linear feet in the workpiece prior to failure. Evidence of failure of each PDC is best shown in FIG. 7 where the measured temperature of each PDC during cutting increased dramatically at about 1000 and 2000 linear feet for the two PDCs, respectively.

Working Example 3

Figure 5:
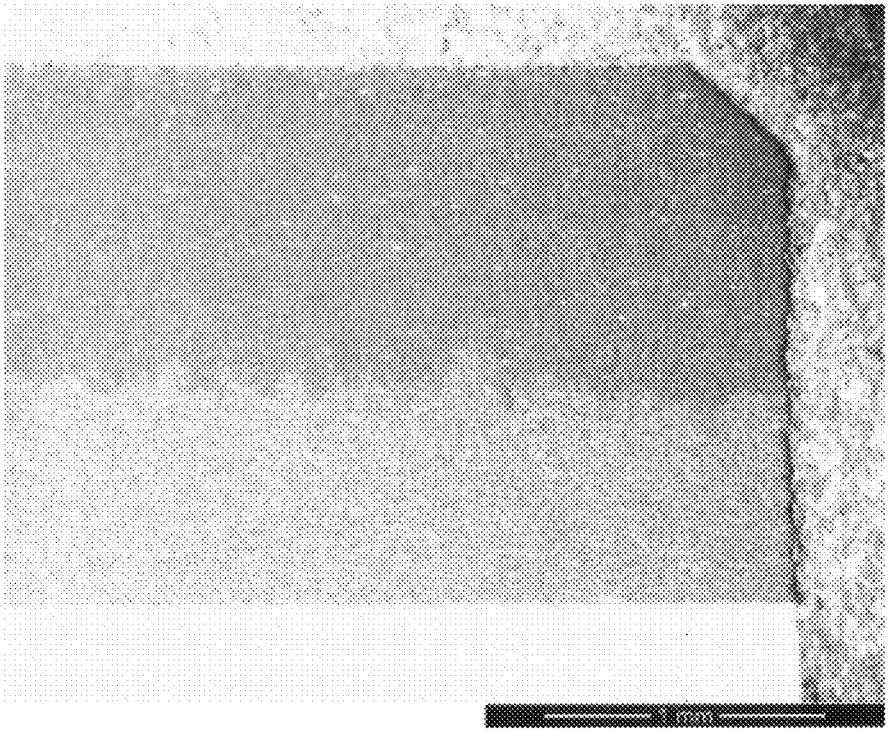
FIG. 5 is a photomicrograph of a PCD table of a PDC formed according to working example 3 of the present invention.

Two PDCs were formed according to the following process. A layer of diamond particles having the same particle size distribution as comparative example A was placed adjacent to a first cobalt-cemented tungsten carbide substrate. The diamond particles and the first cobalt-cemented tungsten carbide substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the first cobalt-cemented tungsten carbide substrate. The PCD table was then separated from the first cobalt-cemented tungsten carbide substrate by grinding away the first cemented tungsten carbide substrate. The PCD table was leached to remove substantially all of the cobalt from the interstitial regions between diamond grains within the PCD table. The leached PCD table was then placed adjacent to a second cobalt-cemented tungsten carbide substrate. The PCD table and the second cobalt-cemented tungsten carbide substrate were positioned within a pyrophyllite cube, and HPHT processed at a temperature of about 1400° C. and a pressure of about 6.3 GPa for about 250 seconds of soak time (about 400 seconds total process time) at the 1400° C. temperature in a high-pressure cubic press to attach the PCD table to the second cobalt-cemented tungsten carbide substrate. A scanning electron microscope image (FIG. 5) of one of the PDCs so-formed showed incomplete infiltration of cobalt from the second cobalt-cemented tungsten carbide substrate into the PCD table. Infiltration was only achieved through about half the thickness of the PCD table. Infiltration was less than working example 2, perhaps through only about half of the thickness of the PCD table because the pressure of the second HPHT process was higher, with temperature, time, and PCD table thickness being about the same. The dark region of the PCD table is the un-infiltrated region and the light region of the PCD table is the region infiltrated with cobalt.

The thickness of the PCD table of the first PDC was about 0.081 inch and an about 0.013 inch chamfer was machined in the PCD table. The thickness of the PCD table of the second PDC was about 0.082 inch and an about 0.013 inch chamfer was machined in the PCD table.

The thermal stability of the unleached PDC so-formed was evaluated by measuring the distance cut in the same Sierra White granite workpiece as Comparative Example A prior to failure without using coolant in a vertical turret lathe test and using the same test parameters. The distance cut is considered representative of the thermal stability of the PDC. One of the unleached PDCs was able to cut a distance of about 5500 linear feet in the workpiece without failing and without using coolant. The other was able to cut a distance of about 9000 linear feet in the workpiece without failing and without using coolant. This is best shown in FIG. 7 where the distance cut prior to failure of the PDCs of example 3 during cutting of the workpiece is greater than that of the conventional PDC of comparative examples A and B during cutting. Therefore, thermal stability tests indicate that the PDCs of example 3 exhibited a significantly improved thermal stability compared to the conventional unleached PDC of comparative example A, as well as compared to the conventional leached PDC of comparative example B.

Working Example 4

Figure 6:
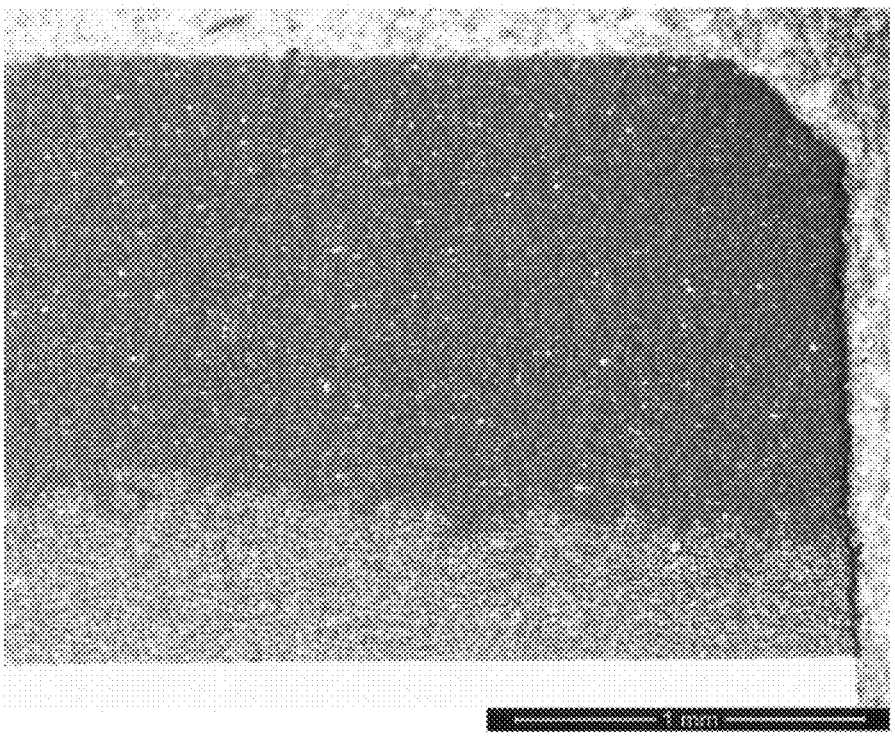
FIG. 6 is a photomicrograph of a PCD table of a PDC formed according to working example 4 of the present invention.

Two PDCs were formed according to the following process. A layer of diamond particles having the same particle size distribution as comparative example A was placed adjacent to a first cobalt-cemented tungsten carbide substrate. The diamond particles and the first cobalt-cemented tungsten carbide substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the first cobalt-cemented tungsten carbide substrate. The PCD table was then separated from the first cobalt-cemented tungsten carbide substrate by grinding away the first cemented tungsten carbide substrate. The PCD table was subsequently leached to remove substantially all of the cobalt from the interstitial regions between diamond grains within the PCD table. The leached PCD table was then placed adjacent to a second cobalt-cemented tungsten carbide substrate. The PCD table and the second cobalt-cemented tungsten carbide substrate were positioned within a pyrophyllite cube, and HPHT processed at a temperature of about 1400° C. and a pressure of about 7 GPa for about 250 seconds of soak time (about 400 seconds total process time) at the 1400° C. temperature in a high-pressure cubic press to attach the PCD table to the second cobalt-cemented tungsten carbide substrate. A scanning electron microscope image (FIG. 6) of one of the PDCs so-formed showed incomplete infiltration of cobalt from the second cobalt-cemented tungsten carbide substrate into the PCD table. Infiltration was less than working example 3, perhaps through only about one-third the thickness of the PCD table because the pressure of the second HPHT process was higher, with temperature, time and PCD table thickness being about the same. The dark region of the PCD table is the un-infiltrated region and the light region of the PCD table is the region infiltrated with cobalt.

The thickness of the PCD table of the first PDC was about 0.075 inch and an about 0.013 inch chamfer was machined in the PCD table. The thickness of the PCD table of the second PDC was about 0.077 inch and an about 0.013 inch chamfer was machined in the PCD table.

The thermal stability of the unleached PDC so-formed was evaluated by measuring the distance cut in the same Sierra White granite workpiece as Comparative Example A prior to failure without using coolant in a vertical turret lathe test and using the same test parameters. The distance cut is considered representative of the thermal stability of the PDC. Both of the unleached PDCs were able to cut a distance of about 13500 linear feet in the workpiece without failing and without using coolant. This is best shown in FIG. 7 where the distance cut prior to failure of the PDCs of example 4 during cutting of the workpiece is greater than that of the conventional PDCs of comparative examples A and B. Therefore, thermal stability tests indicate that the PDCs of example 4 exhibited a significantly improved thermal stability compared to the conventional unleached PDC of comparative example A, as well as the conventional leached PDC of comparative example B.

Thermal stability tests as shown in FIG. 7 indicate that the PDCs of working examples 3 and 4, particularly example 4, exhibited a significantly improved thermal stability compared to what might be expected even relative to conventional leached PDCs. In particular, because infiltration into the PCD table of examples 3 and 4 is incomplete, leaching after infiltration is not required in order to achieve results similar to or even far superior to a conventional leached PDC.

Wear Resistance of Comparative Examples A and B and Working Examples 1-4

The wear resistance of the PDCs formed according to comparative examples A and B, as well as working examples 1-4 were evaluated by measuring the volume of the PDC removed versus the volume of a Sierra White granite workpiece removed in a vertical turret lathe with water used as a coolant. The test parameters were a depth of cut for the PDC of about 0.254 mm, a back rake angle for the PDC of about 20 degrees, an in-feed for the PDC of about 6.35 mm/rev, and a rotary speed of the workpiece to be cut of about 101 RPM.

Figure 8:
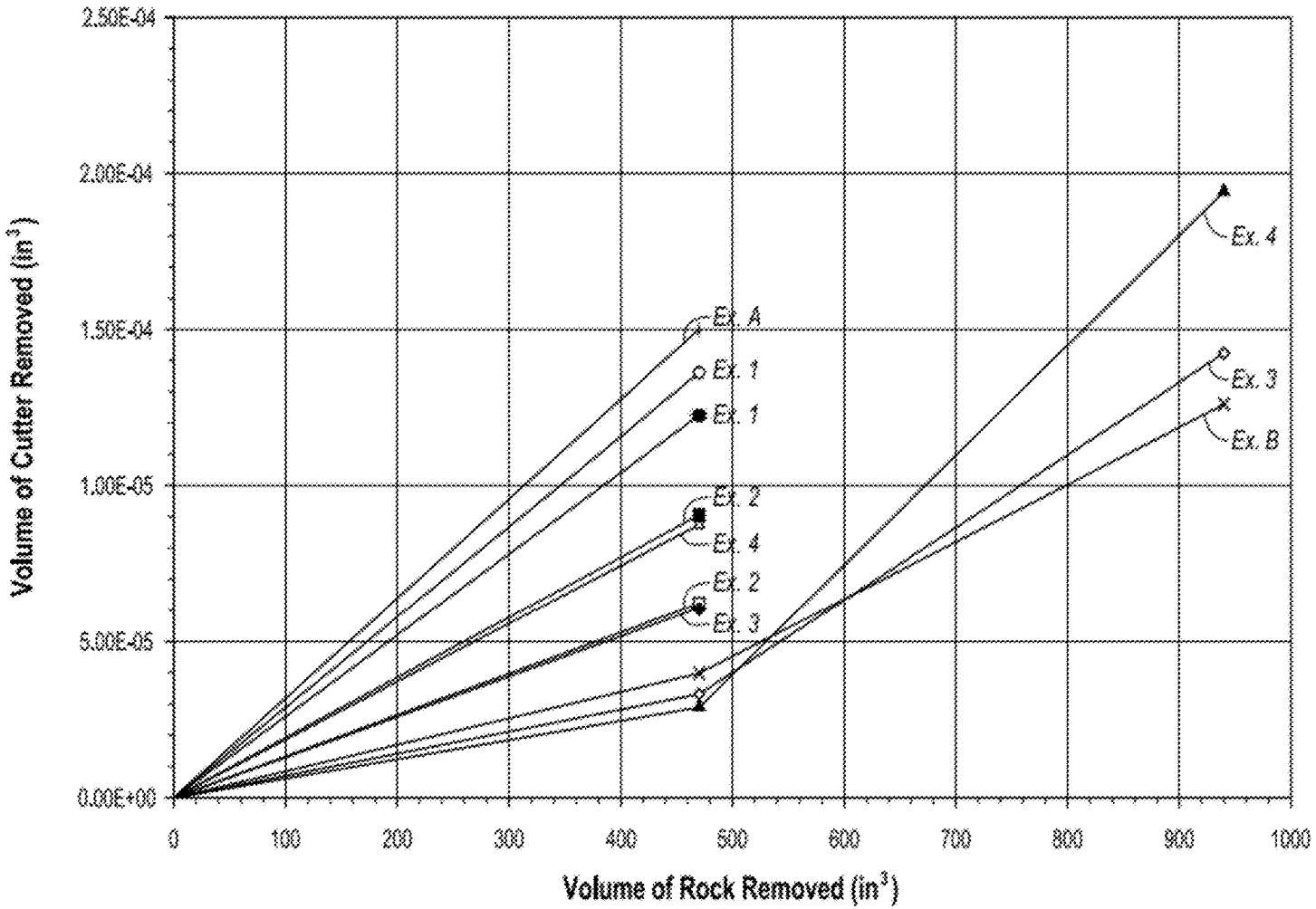
FIG. 8 is a graph showing the wear flat volume characteristics of some conventional PDCs and several unleached PDCs according to working examples 1-4 of the present invention.

As shown in FIG. 8, the wearflat volume tests indicated that the PDCs of unleached examples 1-4 generally exhibited better wear resistance compared to the wear resistance of the unleached PDC of comparative example A. In particular, the unleached PDC of comparative example A exhibited the worst wear resistance, followed by both samples of working example 1. Working examples 1 and 2, which were fully infiltrated and not subsequently leached showed better wear resistance than the unleached PDC of comparative example A. Working examples 3 and 4 were only partially infiltrated and provided even better wear resistance. The wear resistance of working examples 3 and 4 was similar, and in some cases even better, than the leached PDC of comparative example B.

Comparative Example C

A PDC was formed according to the following process. A layer of diamond particles having the same particle size distribution as comparative example A was placed adjacent to a cobalt-cemented tungsten carbide substrate. The diamond particles and the substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the substrate.

Figure 9:
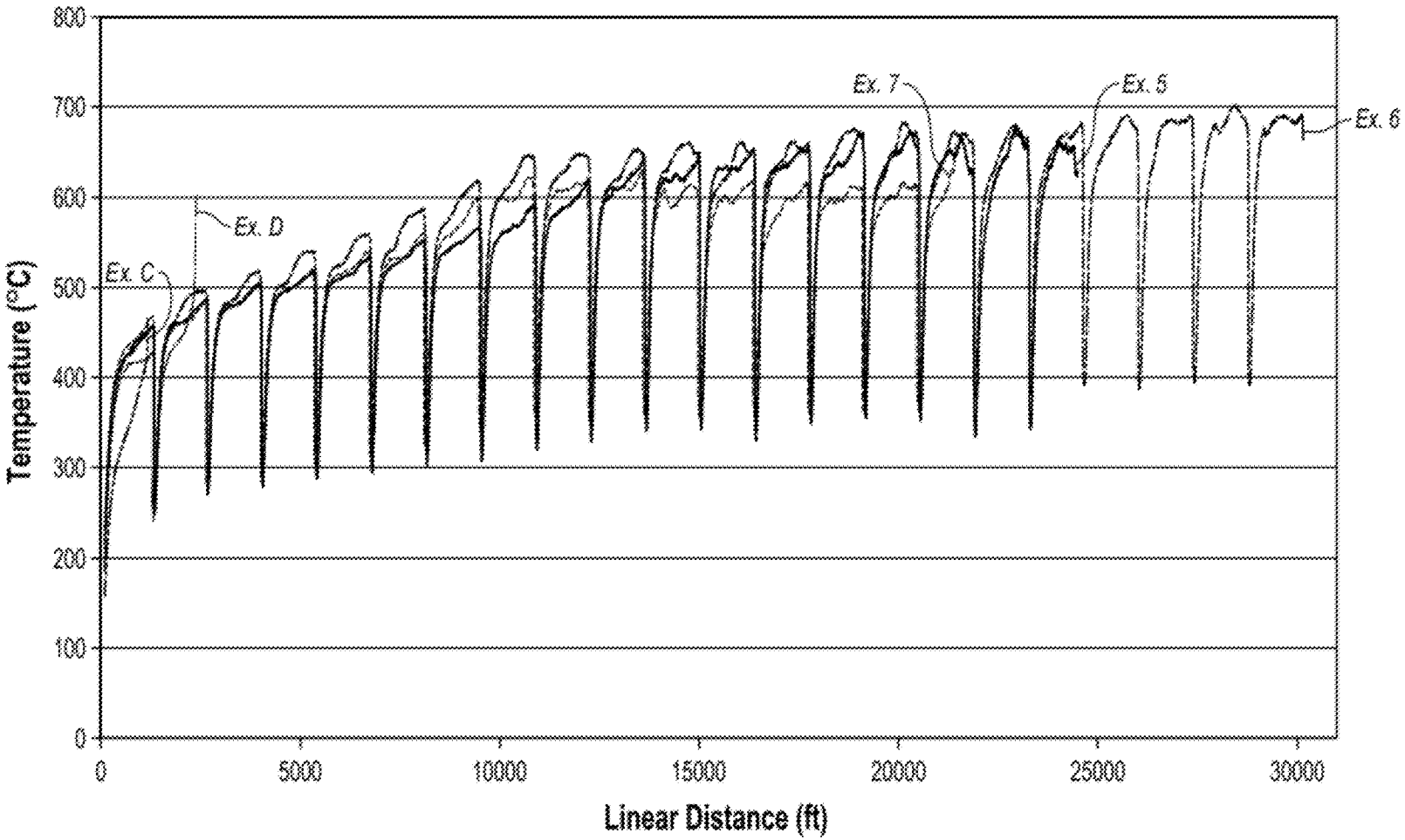
FIG. 9 is a graph illustrating the measured temperature versus linear distance cut during a vertical turret lathe test on some conventional PDCs and several PDCs according to additional working examples 5-7 of the present invention that were leached after reattachment.

The thickness of the polycrystalline diamond table of the PDC was about 0.086 inches and an about 0.012 inch chamfer was machined in the polycrystalline diamond table. The thermal stability of the conventional unleached PDC so-formed was evaluated by measuring the distance cut in a Sierra White granite workpiece prior to failure without using coolant in a vertical turret lathe test using the same test parameters as comparative example A. The distance cut is considered representative of the thermal stability of the PDC. The conventional unleached PDC was able to cut a distance of only about 1000 linear feet in the workpiece prior to failure. Evidence of failure of the conventional unleached PDC is best shown in FIG. 9 where the measured temperature of the conventional unleached PDC during cutting increased dramatically at about 1000 linear feet.

Comparative Example D

A PDC was formed according to the following process. A layer of diamond particles having the same particle size distribution as comparative example A was placed adjacent to a cobalt-cemented tungsten carbide substrate. The diamond particles and the substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the substrate. The PCD table was subsequently leached to remove the cobalt from the interstitial regions between diamond grains within the PCD table to a depth of 78 μm.

The thickness of the PCD table of the PDC was about 0.092 inches and an about 0.013 inch chamfer was machined in the polycrystalline diamond table. The thermal stability of the conventional PDC so-formed was evaluated by measuring the distance cut in the same Sierra White granite workpiece as Comparative Example C prior to failure without using coolant in a vertical turret lathe test. The distance cut is considered representative of the thermal stability of the PDC. The conventional leached PDC was able to cut a distance of about 2000 linear feet in the workpiece prior to failure. Evidence of failure of the conventional PDC is best shown in FIG. 9 where the measured temperature of the conventional PDC during cutting increased dramatically at about 2000 linear feet.

Working Example 5

A PDC was formed according to the following process. A layer of diamond particles having the same particle size distribution as comparative example A was placed adjacent to a first cobalt-cemented tungsten carbide substrate. The diamond particles and the first cobalt-cemented tungsten carbide substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the first cobalt-cemented tungsten carbide substrate. The PCD table was then separated from the first tungsten carbide substrate by grinding away the first cobalt-cemented tungsten carbide substrate. The PCD table was then placed adjacent to a second cobalt-cemented tungsten carbide substrate. The PCD table and the second cobalt-cemented tungsten carbide substrate were positioned within a pyrophyllite cube, and HPHT processed at a temperature of about 1400° C. and a pressure of about 6.1 GPa for about 250 seconds of soak time (about 400 seconds total process time) at the 1400° C. temperature in a high-pressure cubic press to attach the PCD table to the second cobalt-cemented tungsten carbide substrate. Scanning electron microscope images of the PDC so-formed showed incomplete infiltration of cobalt from the second cobalt-cemented tungsten carbide substrate into the PCD table. The PCD was electrically non-conductive prior to leaching. The PCD table was subsequently leached for about 2 hours in nitric acid so as to remove cobalt from the interstitial regions between diamond grains within the PCD table.

The thickness of the PCD table of the PDC was about 0.078 inch and an about 0.012 inch chamfer was machined in the PCD table. The thermal stability of the unleached PDC so-formed was evaluated by measuring the distance cut in the same Sierra White granite workpiece as Comparative Example C prior to failure without using coolant in a vertical turret lathe test. The distance cut is considered representative of the thermal stability of the PDC. The PDC was able to cut a distance of about 24000 linear feet in the workpiece without failing and without using coolant. This is best shown in FIG. 9 where the distance cut prior to failure of the PDC of example 5 during cutting of the workpiece is greater than that of the conventional PDC of comparative examples C and D during cutting. Therefore, thermal stability tests indicate that the PDC of example 5 exhibited a significantly improved thermal stability compared to the conventional PDCs of comparative examples C and D.

Working Example 6

A PDC was formed according to the following process. A layer of diamond particles having the same particle size distribution as comparative example A was placed adjacent to a first cobalt-cemented tungsten carbide substrate. The diamond particles and the first cobalt-cemented tungsten carbide substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the first cobalt-cemented tungsten carbide substrate. The PCD table was then separated from the first tungsten carbide substrate by grinding away the first cemented tungsten carbide substrate. The PCD table was then placed adjacent to a second cobalt-cemented tungsten carbide substrate. The PCD table and the second cobalt-cemented tungsten carbide substrate were positioned within a pyrophyllite cube, and HPHT processed at a temperature of about 1400° C. and a pressure of about 6.1 GPa for about 250 seconds of soak time (about 400 seconds total process time) at the 1400° C. temperature in a high-pressure cubic press to attach the PCD table to the second tungsten carbide substrate. Scanning electron microscope images of the PDC so-formed showed incomplete infiltration of cobalt from the second cobalt-cemented tungsten carbide substrate into the PCD table. The PCD was electrically non-conductive prior to leaching. The PCD table was subsequently leached for about 2 hours in nitric acid to remove cobalt from the interstitial regions between diamond grains within the PCD table.

The thickness of the polycrystalline diamond table of the PDC was about 0.081 inch and an about 0.012 inch chamfer was machined in the polycrystalline diamond table. The thermal stability of the unleached PDC so-formed was evaluated by measuring the distance cut in the same Sierra White granite workpiece as comparative example C prior to failure without using coolant in a vertical turret lathe test. The distance cut is considered representative of the thermal stability of the PDC. The PDC was able to cut a distance of about 30000 linear feet in the workpiece without failing and without using coolant. This is best shown in FIG. 9 where the distance cut prior to failure of the PDC of example 6 during cutting of the workpiece is greater than that of the conventional PDC of comparative examples C and D during cutting. Therefore, thermal stability tests indicate that the PDC of example 6 exhibited a significantly improved thermal stability compared to the conventional PDCs of comparative examples C and D.

Working Example 7

A PDC was formed according to the following process. A layer of diamond particles having the same particle size distribution as comparative example A was placed adjacent to a first cobalt-cemented tungsten carbide substrate. The diamond particles and the first cobalt-cemented tungsten carbide substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the first tungsten carbide substrate. The PCD table was then separated from the first cobalt-cemented tungsten carbide substrate by grinding away the first cemented tungsten carbide substrate. The PCD table was then placed adjacent to a second cobalt-cemented tungsten carbide substrate. The PCD table and the second cobalt-cemented tungsten carbide substrate were positioned within a pyrophyllite cube, and HPHT processed at a temperature of about 1400° C. and a pressure of about 6.1 GPa for about 250 seconds of soak time (about 400 seconds total process time) at the 1400° C. temperature in a high-pressure cubic press to attach the PCD table to the second cobalt-cemented tungsten carbide substrate. Scanning electron microscope images of the PDC so-formed showed incomplete infiltration of cobalt from the second cobalt-cemented tungsten carbide into the PCD table. The PCD was electrically non-conductive prior to leaching. The PCD table was subsequently leached for about 2 hours in nitric acid so as to remove cobalt from the interstitial regions between diamond grains within the PCD table.

The thickness of the polycrystalline diamond table of the PDC was about 0.082 inch and an about 0.012 inch chamfer was machined in the polycrystalline diamond table. The thermal stability of the unleached PDC so-formed was evaluated by measuring the distance cut in the same Sierra White granite workpiece as comparative example C prior to failure without using coolant in a vertical turret lathe test. The distance cut is considered representative of the thermal stability of the PDC. The PDC was able to cut a distance of about 22000 linear feet in the workpiece without using coolant prior to failing. This is best shown in FIG. 9 where the measured temperature of the PDC of example 7 during cutting of the workpiece increases dramatically at about 22000 linear feet. Therefore, thermal stability tests indicate that the PDC of example 7 exhibited a significantly improved thermal stability compared to the conventional PDCs of comparative examples C and D.

Wear Resistance of Comparative Examples C and D and Working Examples 5-7

The wear resistance of PDCs formed according to comparative examples C and D, as well as working examples 5-7 was evaluated by measuring the volume of the PDC removed versus the volume of a Sierra White granite workpiece removed in a vertical turret lathe with water used as a coolant. The test parameters were a depth of cut for the PDC of about 0.254 mm, a back rake angle for the PDC of about 20 degrees, an in-feed for the PDC of about 6.35 mm/rev, and a rotary speed of the workpiece to be cut of about 101 RPM.

Figure 10:
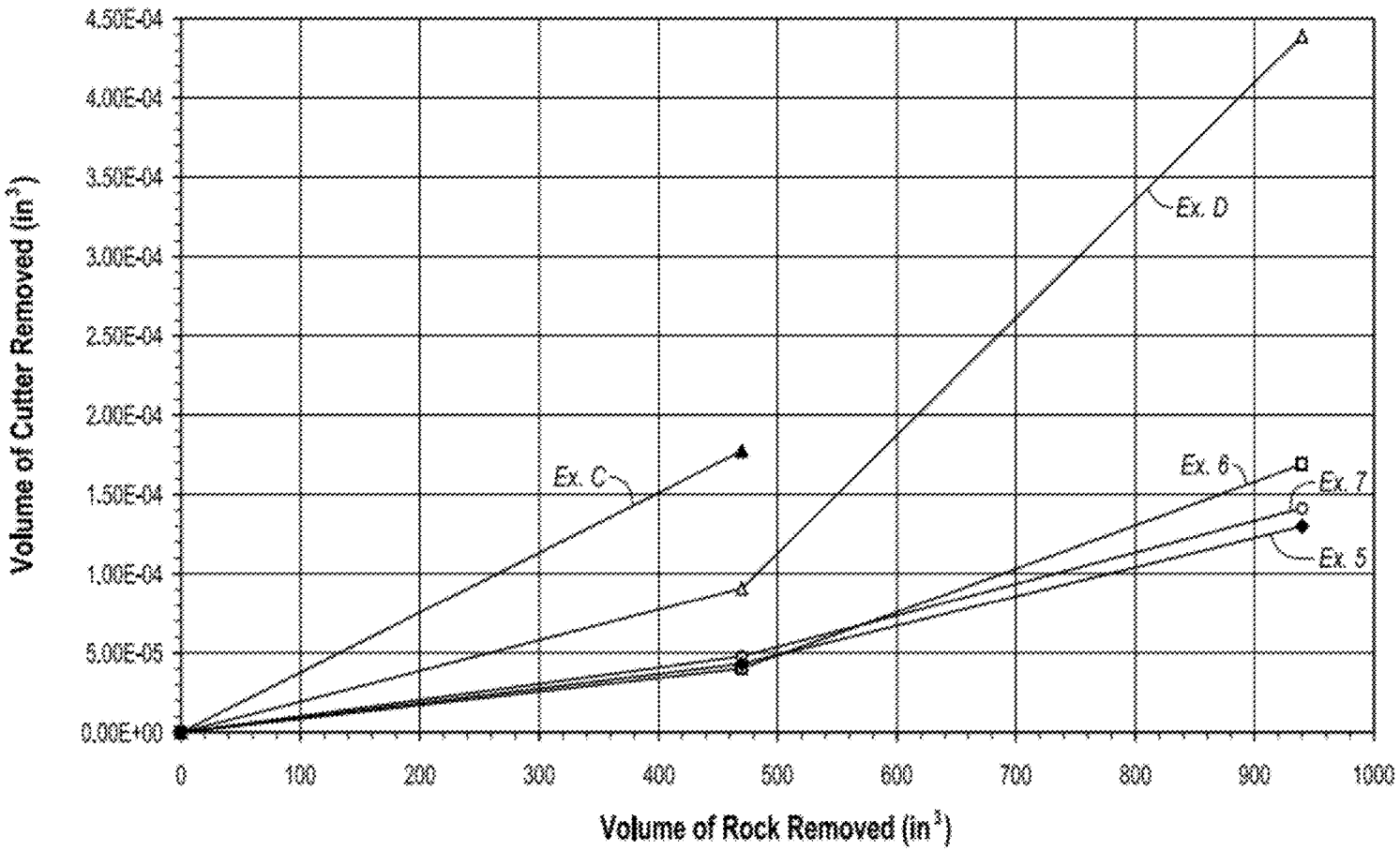
FIG. 10 is a graph illustrating the wear flat volume characteristics of some conventional PDCs and several PDCs according to additional working examples 5-7 of the present invention that were leached after reattachment.

As shown in FIG. 10, the wearflat volume tests indicated that the PDCs of examples 5-7 generally exhibited better wear resistance compared to the wear resistance of the PDC of unleached comparative example C, as well as leached comparative example D. In particular, unleached comparative example C exhibited the lowest wear resistance, followed by comparative example D. Working examples 5 through 7, which were only partially infiltrated and then also subsequently leached, showed better wear resistance than either comparative example C or D. The partial infiltration is believed to result in a more uniform leaching profile during leaching of the PCD table, which may at least partially contributes to the better wear resistance exhibited by working examples 5-7.

The PDCs formed according to the various embodiments disclosed herein may be used as PDC cutting elements on a rotary drill bit. For example, in a method according to an embodiment of the invention, one or more PDCs may be received that were fabricated according to any of the disclosed manufacturing methods and attached to a bit body of a rotary drill bit.

Figure 11:
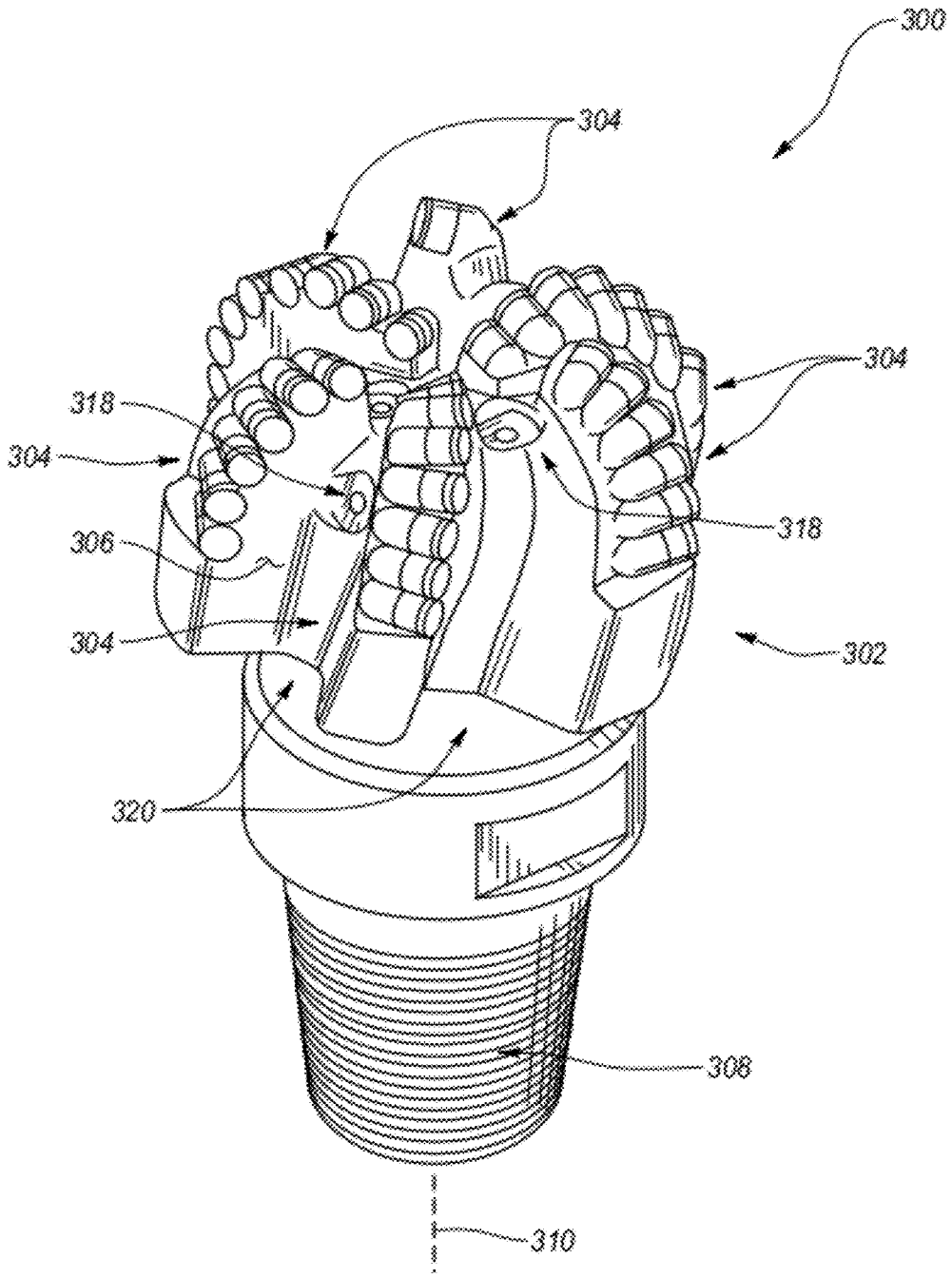
FIG. 11 is an isometric view of an embodiment of a rotary drill bit that may employ one or more of the disclosed PDC embodiments.
Figure 12:
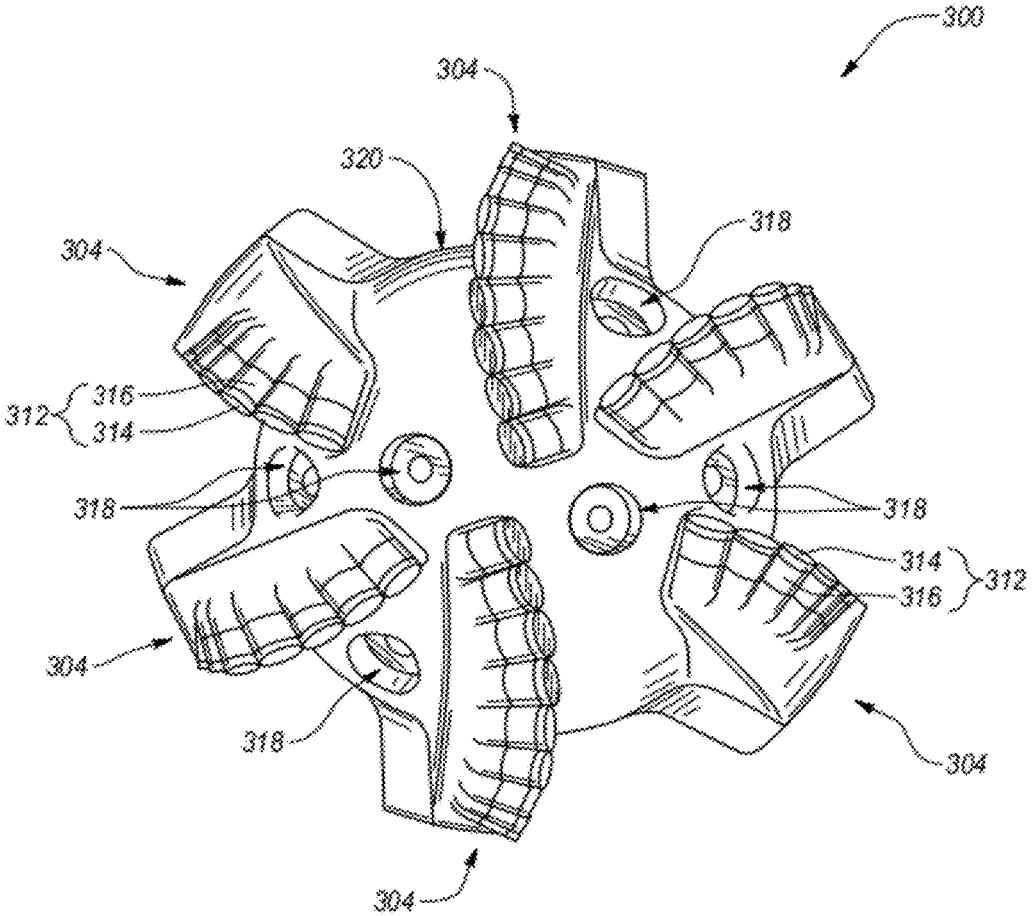
FIG. 12 is a top elevation view of the rotary drill bit shown in FIG. 11.

FIG. 11 is an isometric view and FIG. 12 is a top elevation view of an embodiment of a rotary drill bit 300 that includes at least one PDC configured and/or fabricated according to any of the disclosed PDC embodiments. The rotary drill bit 300 comprises a bit body 302 that includes radially and longitudinally extending blades 304 having leading faces 306, and a threaded pin connection 308 for connecting the bit body 302 to a drilling string. The bit body 302 defines a leading end structure for drilling into a subterranean formation by rotation about a longitudinal axis 310 and application of weight-on-bit. At least one PDC, configured according to any of the previously described PDC embodiments, may be affixed to the bit body 302. With reference to FIG. 12, each of a plurality of PDCs 312 is secured to the blades 304 of the bit body 302 (FIG. 11). For example, each PDC 312 may include a PCD table 314 bonded to a substrate 316. More generally, the PDCs 312 may comprise any PDC disclosed herein, without limitation. For example, in one embodiment, the PCD table 314 may include first and second regions where the region adjacent the upper exterior surface of PCD table 314 was not infiltrated during attachment of the PCD table 314 to the substrate 316. In one such embodiment, the PCD table 314 has not been subjected to a leaching process after attachment of PCD table 314 to substrate 316, although the region adjacent the upper exterior surface may still be substantially void of infiltrant. For example, the region adjacent the upper exterior surface may be essentially free of an infiltrant, such as silicon, a reaction product of silicon such as silicon carbide, nickel, nickel alloys, or combinations of the foregoing. Such an embodiment may provide the same or better wear resistance and/or thermal stability performance of a leached PCD table integrally formed on a substrate (i.e., a one-step PDC) without leaching.

In addition, if desired, in some embodiments, a number of the PDCs 312 may be conventional in construction. Also, circumferentially adjacent blades 304 define so-called junk slots 320 therebetween. Additionally, the rotary drill bit 300 includes a plurality of nozzle cavities 318 for communicating drilling fluid from the interior of the rotary drill bit 300 to the PDCs 312.

FIGS. 11 and 12 merely depict one embodiment of a rotary drill bit that employs at least one PDC fabricated and structured in accordance with the disclosed embodiments, without limitation. The rotary drill bit 300 is used to represent any number of earth-boring tools or drilling tools, including, for example, core bits, roller-cone bits, fixed-cutter bits, eccentric bits, bi-center bits, reamers, reamer wings, or any other downhole tool including superabrasive compacts, without limitation.

The PDCs disclosed herein (e.g., PDC 100 of FIG. 1) may also be utilized in applications other than cutting technology. For example, the disclosed PDC embodiments may be used in wire dies, bearings, artificial joints, inserts, cutting elements, and heat sinks. Thus, any of the PDCs disclosed herein may be employed in an article of manufacture including at least one superabrasive element or compact.

Thus, the embodiments of PDCs disclosed herein may be used in any apparatus or structure in which at least one conventional PDC is typically used. In one embodiment, a rotor and a stator, assembled to form a thrust-bearing apparatus, may each include one or more PDCs (e.g., PDC 100 of FIG. 1) configured according to any of the embodiments disclosed herein and may be operably assembled to a downhole drilling assembly. U.S. Pat. Nos. 4,410,054; 4,560,014; 5,364,192; 5,368,398; 5,480,233; 7,552,782; and 7,559,695, the disclosure of each of which is incorporated herein, in its entirety, by this reference, disclose subterranean drilling systems within which bearing apparatuses utilizing superabrasive compacts disclosed herein may be incorporated. The embodiments of PDCs disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the PDCs disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,460,233; 5,544,713; and 6,793,681, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A method of fabricating a polycrystalline diamond compact, comprising:

forming a polycrystalline diamond table in the presence of a metal-solvent catalyst including one of cobalt, iron, nickel, or alloys thereof in a first high-pressure/high-temperature process, the polycrystalline diamond table including a plurality of bonded diamond grains defining a plurality of interstitial regions, at least a portion of the plurality of interstitial regions including the metal-solvent catalyst disposed therein, the plurality of bonded diamond grains exhibiting an average grain size of about 40 μm or less;

at least partially leaching the polycrystalline diamond table to remove at least a portion of the metal-solvent catalyst therefrom;

subjecting the at least partially leached polycrystalline diamond table and a substrate to a second high-pressure/high-temperature process under diamond-stable temperature-pressure conditions to partially infiltrate the at least partially leached polycrystalline table with an infiltrant including one of iron, nickel, cobalt, or alloys of the foregoing metals and attach the partially infiltrated polycrystalline diamond table to the substrate;

wherein a maximum temperature (T), a total process time (t), and a maximum internal cell pressure (P) of the second high-pressure/high-temperature process are chosen so that β is greater than 75° Celsius·hours/gigapascals ("° C.·h/GPa") to about 325° C.·h/GPa, with β represented as $\beta=T\cdot t/P$;

wherein P in the second high-pressure/high-temperature process is greater than a maximum internal cell pressure of the first high-pressure/high-temperature process; and wherein the infiltrated polycrystalline diamond table includes a first region adjacent to the substrate including the infiltrant disposed in at least a portion of the interstitial regions thereof and a second region extending inwardly from an exterior working surface to a selected depth of at least about 700 μm, the second region being substantially free of the infiltrant without having been leached of the infiltrant.

2. The method of claim 1 wherein P is about 6 GPa to about 10 GPa, T is about 1250° C. to about 3250° C., and t is about 60 seconds to about 1 hour.

3. The method of claim 1 wherein P is about 6 GPa to about 8 GPa, T is about 1250° C. to about 1500° C., and t is about 200 seconds to about 450 seconds.

4. The method of claim 1 wherein β is about 75° C.·h/GPa to about 100° C.·h/GPa.

5. The method of claim 1 wherein β is about 75° C.·h/GPa to about 150° C.·h/GPa.

6. The method of claim 1 wherein p is about 100° C.·h/GPa to about 200° C.·h/GPa.

7. The method of claim 1 wherein the selected depth is about 750 μm to about 2100 μm.

8. The method of claim 1 wherein the selected depth is about 1000 μm to about 2000 μm.

9. The method of claim 1 wherein the infiltrated polycrystalline diamond table comprises a nonplanar interface between the first region and the second region.

10. The method of claim 1 wherein at least one of T or t of the first high-pressure/high-temperature conditions are different from a maximum temperature or total process time of the second high-pressure/high-temperature conditions.

11. The method of claim 1 wherein the infiltrant is provided from the substrate.

12. The method as recited in claim 1 wherein the second region of the infiltrated polycrystalline diamond table is essentially free of silicon, nickel, or combinations thereof.

13. The method of claim 1, further comprising:

positioning the plurality of diamond particles adjacent to a first substrate;

wherein the first high-pressure/high-temperature process comprises subjecting the plurality of diamond particles and the first substrate to the first high-pressure/high-temperature process to sinter the plurality of diamond particles and form a polycrystalline diamond table on the first substrate; and further comprising separating the polycrystalline diamond table from the first substrate.

14. The method of claim 1 wherein a thickness of the infiltrated polycrystalline diamond table is about 0.065 inch to about 0.080 inch.

15. The method of claim 1 wherein the average grain size of the polycrystalline diamond table is about 30 μm or less.

16. The method of claim 1 wherein a thickness of the infiltrated polycrystalline diamond table is about 0.065 inch to about 0.080 inch, and the average grain size of the polycrystalline diamond table is about 30 μm or less.

17. The method of claim 1, further comprising attaching the substrate having the infiltrated polycrystalline diamond table attached thereto to a bit body of a rotary drill bit.

18. A method of fabricating a rotary drill bit, comprising:

attaching at least one polycrystalline diamond compact to a bit body of the rotary drill bit by a method including:

forming a polycrystalline diamond table in the presence of a metal-solvent catalyst including one of cobalt, iron, nickel, or alloys thereof in a first high-pressure/high-temperature process, the polycrystalline diamond table including a plurality of bonded diamond grains defining a plurality of interstitial regions, at least a portion of the plurality of interstitial regions including the metal-solvent catalyst disposed therein, the plurality of bonded diamond grains exhibiting an average grain size of about 40 μm or less;

at least partially leaching the polycrystalline diamond table to remove at least a portion of the metal-solvent catalyst therefrom;

subjecting the at least partially leached polycrystalline diamond table and a substrate to a second high-pressure/high-temperature process under diamond-stable temperature-pressure conditions to partially infiltrate the at least partially leached polycrystalline table with an infiltrant including at least one additional metal-solvent catalyst including one of cobalt, iron, nickel, or alloys thereof and attach the partially infiltrated polycrystalline diamond table to the substrate;

wherein a maximum temperature (T), a total process time (t), and a maximum internal cell pressure (P) of the second high-pressure/high-temperature process are chosen so that β is greater than 75° Celsius·hours/gigapascals ("° C.·h/GPa") to about 325° C.·h/GPa, with β represented as $\beta=T\cdot t/P$;

wherein P in the second high-pressure/high-temperature process is greater than a maximum internal cell pressure of the first high-pressure/high-temperature process; and wherein the infiltrated polycrystalline diamond table includes a first region adjacent to the substrate including the infiltrant disposed in at least a portion of the interstitial regions thereof and a second region extending inwardly from an exterior working surface to a selected depth of at least about 700 μm, the second region being substantially free of the infiltrant without having been leached of the infiltrant.

19. The polycrystalline diamond compact of claim 1, further comprising at least partially leaching the partially infiltrated polycrystalline diamond table attached to the substrate to remove a portion of the infiltrant material from the first region.

20. The polycrystalline diamond compact of claim 18, further comprising at least partially leaching the partially infiltrated polycrystalline diamond table attached to the substrate to remove a portion of the infiltrant material from the first region.

21. The method of claim 1, wherein the maximum internal cell pressure of the first high-pressure/high-temperature process is about 5 GPa to about 7 GPa and the P of the second high-pressure/high-temperature process is about 6.2 GPa to about 10 GPa.

22. The method of claim 1, wherein the infiltrant includes a cobalt cementing constituent from the substrate.

23. The method of claim 1, wherein the total process time t includes a time to ramp-up to a maximum temperature, a soak time at the maximum temperature, and a cool down time from the maximum temperature.

24. The method of claim 23, wherein the selected depth is at least about one third of a thickness of the infiltrated polycrystalline diamond table.

* * * * *